US010013931B2

(12) United States Patent
Iwasa

(10) Patent No.: US 10,013,931 B2
(45) Date of Patent: Jul. 3, 2018

(54) LIQUID CRYSTAL DISPLAY DEVICE AND PIXEL INSPECTION METHOD THEREFOR

(71) Applicant: JVC KENWOOD Corporation, Yokohama-shi, Kanagawa (JP)

(72) Inventor: Takayuki Iwasa, Yokohama (JP)

(73) Assignee: JVC KENWOOD Corporation, Yokohama-shi (JP)

( * ) Notice: Subject to any disclaimer, the term of this patent is extended or adjusted under 35 U.S.C. 154(b) by 29 days.

(21) Appl. No.: 15/391,568

(22) Filed: Dec. 27, 2016

(65) Prior Publication Data

US 2017/0186384 A1 Jun. 29, 2017

(30) Foreign Application Priority Data

Dec. 25, 2015 (JP) ..... 2015-252776

(51) Int. Cl.

*G09G 3/36* (2006.01)
*G09G 3/20* (2006.01)
*G09G 3/00* (2006.01)

(52) U.S. Cl.

CPC ..... *G09G 3/3607* (2013.01); *G09G 3/006* (2013.01); *G09G 3/2022* (2013.01); *G09G 2310/08* (2013.01); *G09G 2320/029* (2013.01); *G09G 2330/12* (2013.01)

(58) Field of Classification Search

CPC ..... G09G 2320/029; G09G 2330/12; G09G 3/006; G09G 3/2022

See application file for complete search history.

(56) References Cited

U.S. PATENT DOCUMENTS 6,005,558 A * 12/1999 Hudson ..... G09G 3/3614 345/204
2002/0093472 A1* 7/2002 Numao ..... G09G 3/3258 345/87
2003/0011314 A1* 1/2003 Numao ..... G09G 3/3233 315/169.3
2009/0027364 A1* 1/2009 Kwan ..... G09G 3/20 345/204
2014/0232706 A1* 8/2014 Iwasa ..... G02F 1/136213 345/206
2014/0267200 A1* 9/2014 Iwasa ..... G09G 3/006 345/204
2014/0320477 A1* 10/2014 Izawa ..... G09G 3/2022 345/212
2014/0320482 A1* 10/2014 Kawanaka ..... G09G 3/3659 345/214

FOREIGN PATENT DOCUMENTS

JP 2013-114243 6/2013

* cited by examiner

*Primary Examiner* — Priyank Shah
(74) *Attorney, Agent, or Firm* — Procopio

(57) ABSTRACT

According to one embodiment, each pixel of a liquid crystal display device includes: a switch configured to sample subframe data; a storage unit configured to hold the subframe data sampled by the switch, the storage unit and the switch constituting an SRAM cell; and a conductive switch disposed between a liquid crystal display element and an adjacent pixel. A range of a source voltage of NMOS and PMOS transistors constituting each inverter constituting the storage unit of one pixel is configured to be able to be set separately from a range of a source voltage of NMOS and PMOS transistors constituting each inverter constituting the storage unit of another pixel.

14 Claims, 10 Drawing Sheets

LIQUID CRYSTAL DISPLAY DEVICE AND PIXEL INSPECTION METHOD THEREFOR

CROSS REFERENCE TO RELATED APPLICATION

This application is based upon and claims the benefit of priority from Japanese patent application No. 2015-252776, filed on Dec. 25, 2015, the disclosure of which is incorporated herein in its entirety by reference.

BACKGROUND

The present invention relates to a liquid crystal display device and a pixel inspection method therefor. For example, the present invention relates to a liquid crystal display device suitable for accurately inspecting pixels, and a pixel inspection method therefor.

A subframe driving method is known as one of halftone display methods employed in liquid crystal display devices. In a subframe driving method which is one type of time base modulation method, a predetermined period (one frame that is a unit for display of one image in the case of moving pictures, for example) is divided into a plurality of subframes, and pixels are driven in a combination of subframes according to a gradation for display. The gradation for display is determined according to the ratio of a pixel drive period occupied in a predetermined period, and this ratio is specified by the combination of subframes.

In the liquid crystal display devices which employ this subframe driving method, one is known in which pixels are individually composed of a master latch, a slave latch, a liquid crystal display element, and a plurality of switching transistors.

In this pixel, one bit of first data is applied to an input terminal of the master latch through a first switching transistor, and when a row select signal applied through a row scanning line is active, the first switching transistor is turned on and the first data is written into the master latch.

After the writing of data into the master latches provided in all the pixels is completed, second switching transistors provided in all the pixels are turned on in a subframe period. As a result, the data that are written into the master latches provided in all the pixels are simultaneously read out to the slave latches, and the data that are written into the slave latches are applied to the pixel electrode of the liquid crystal display element. In each subframe period, similar processes are performed on all the pixels. As a result, a desired gradation display can be performed with combinations of a plurality of subframes constituting one frame.

The periods of the plurality of subframes constituting one frame are allocated to the same or different predetermined periods. For example, in each pixel, when a maximum gradation display is performed (white is displayed), the display is performed on all the plurality of subframes constituting one frame. When a minimum gradation display is performed (black is displayed), the display is not performed on all the subframes constituting one frame, and subframes for display are selected according to the gradation for display in a case where the other gradation displays are performed. This liquid crystal display device of the related art uses digital data indicating a gradation as input data and adopts a digital driving method using a two-stage latch configuration.

A method for inspecting pixels by connecting adjacent pixels is known as a pixel inspection method. For example, Japanese Patent No. 5765205 discloses a pixel inspection method for a liquid crystal display device including pixels each including a master latch unit composed of an SRAM and a slave latch unit composed of a DRAM. In the pixel inspection method, switching means capable of rendering right and left adjacent pixel electrodes conductive is provided and a pixel inspection is performed by reading out data input to a first pixel from a second pixel.

SUMMARY

According to the pixel inspection method disclosed in Japanese Patent No. 5765205, in a pair of pixels connected by the switching means, the master latch of the pixel from which the test result is read out performs data write/read with an input-output relationship opposite to that in a normal operation. More specifically, test data from an output terminal is written into the master latch provided in the pixel from which the test result is read out, and the written test data is read out from an input terminal. In the pixel inspection method disclosed in Japanese Patent No. 5765205, the setting range of an intermediate voltage mid is narrow. Accordingly, in view of process variations and differences in performance in each foundry, for example, there is a possibility that pixels cannot be accurately inspected under all variation conditions.

A liquid crystal display device according to an aspect of one embodiment includes a plurality of pixels each configured to display an image for one frame with a gradation level corresponding to a plurality of pieces of 1-bit subframe data. Each of the pixels includes: a first switch configured to sample the subframe data; a first data holding unit configured to hold the subframe data sampled by the first switch, the first data holding unit and the first switch constituting an SRAM cell; and a liquid crystal display element including: a reflecting electrode to which the subframe data held in the first data holding unit is applied; a common electrode; and a liquid crystal filled and encapsulated in a space between the reflecting electrode and the common electrode. The first data holding unit includes: a first inverter, an input of the first inverter being connected to each of an output of a second inverter and the first switch, an output of the first inverter being connected to an input of the second inverter; and the second inverter, an input of the second inverter being connected to the output of the first inverter, the output of the second inverter being connected to the input of the first inverter. The liquid crystal display device further comprises a conductive switch configured to be turned on during pixel inspection, the conductive switching being disposed between the reflecting electrodes of first and second pixels among the plurality of pixels, the first pixel including the first switch connected to a first data line, the second pixel including the first switch connected to a second data line. A range of a source voltage of each of an NMOS transistor and a PMOS transistor constituting each of the first and second inverters provided in the first pixel is configured to be able to be set separately from a range of a source voltage of each of an NMOS transistor and a PMOS transistor constituting each of the first and second inverters provided in the second pixel.

A pixel inspection method for a liquid crystal display device according to another aspect of one embodiment is a pixel inspection method for a liquid crystal display device including a plurality of pixels each configured to display an image for one frame with a gradation level corresponding to a plurality of pieces of 1-bit subframe data, each of the pixels including: a first switch configured to sample the subframe data; a first data holding unit configured to hold the subframe data sampled by the first switch, the first data holding unit and the first switch constituting an SRAM cell; and a liquid crystal display element including: a reflecting electrode to which the subframe data held in the first data holding unit is applied; a common electrode; and a liquid crystal filled and encapsulated in a space between the reflecting electrode and the common electrode, the first data holding unit including: a first inverter, an input of the first inverter being connected to each of an output of a second inverter and the first switch, an output of the first inverter being connected to an input of the second inverter; and the second inverter, an input of the second inverter being connected to the output of the first inverter, the output of the second inverter being connected to the input of the first inverter, the liquid crystal display device further including a conductive switch disposed between the reflecting electrodes of first and second pixels among the plurality of pixels, the first pixel including the first switch connected to a first data line, the second pixel including the first switch connected to a second data line, a range of a source voltage of each of an NMOS transistor and a PMOS transistor constituting each of the first and second inverters provided in the first pixel being configured to be able to be set separately from a range of a source voltage of each of an NMOS transistor and a PMOS transistor constituting each of the first and second inverters provided in the second pixel, the pixel inspection method for the liquid crystal display device, including: turning on the conductive switch; a voltage setting step of setting the range of the source voltage of each of the NMOS transistor and the PMOS transistor constituting each of the first and second inverters provided in the first pixel to be larger than the range of the source voltage of each of the NMOS transistor and the PMOS transistor constituting each of the first and second inverters provided in the second pixel; inputting test data to the first data line; and determining presence or absence of a failure in the first and second pixels based on a test result output from the second data line in response to input of the test data to the first data line.

BRIEF DESCRIPTION OF THE DRAWINGS

The above and other aspects, advantages and features will be more apparent from the following description of certain embodiments taken in conjunction with the accompanying drawings, in which.

DETAILED DESCRIPTION

First Exemplary Embodiment

Exemplary embodiments of the present invention will be described with reference to the drawings.

Figure 1:
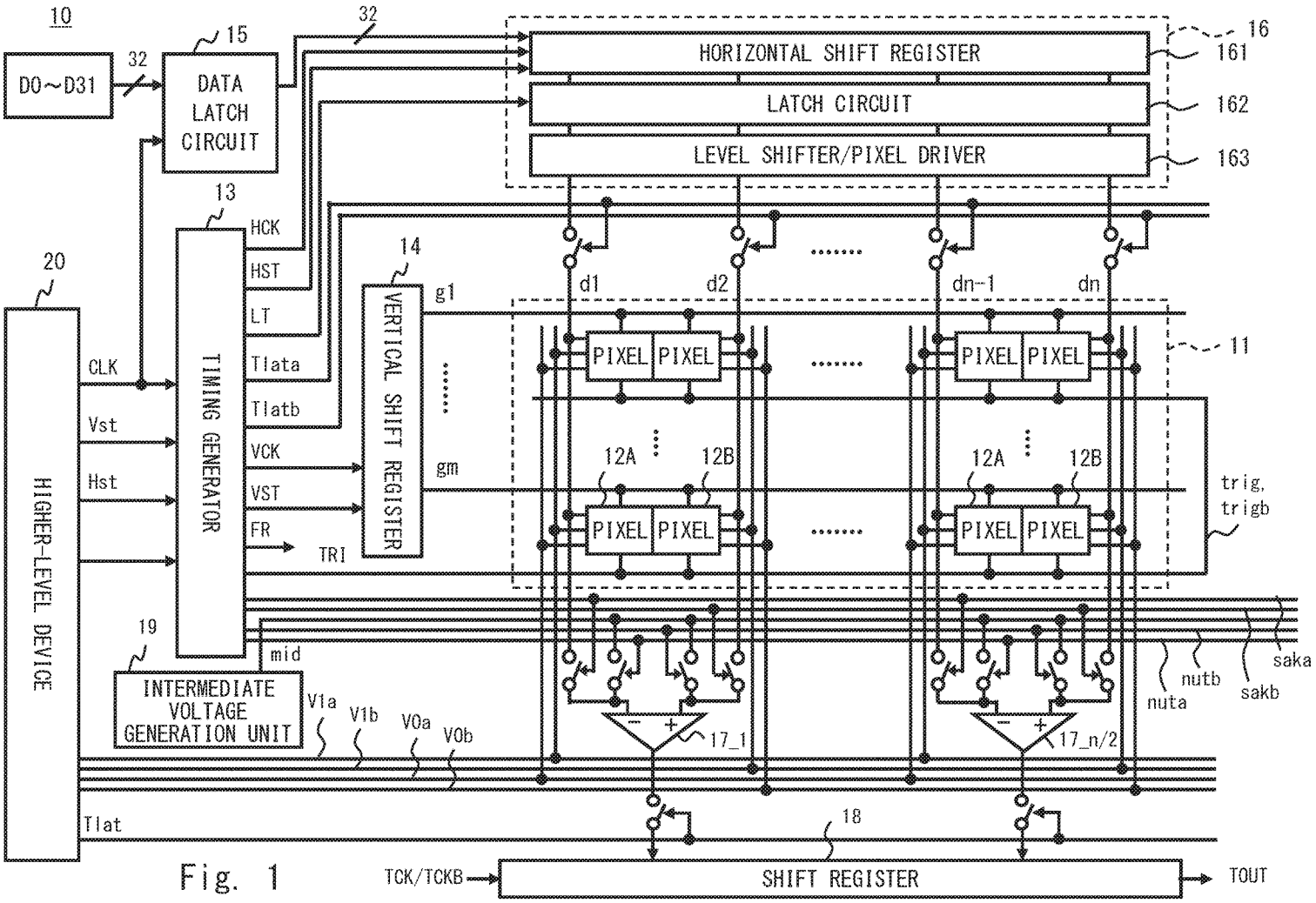
FIG. 1 is a block diagram showing a liquid crystal display device according to a first exemplary embodiment.

FIG. 1 is a block diagram showing a liquid crystal display device 10 according to a first exemplary embodiment.

As shown in FIG. 1, the liquid crystal display device 10 includes an image display unit 11, a timing generator 13, a vertical shift register 14, a data latch circuit 15, a horizontal driver 16, sense amplifiers 17_1 to **17_*n*/2 (n is a natural number equal to or greater than 2), a pixel reading shift register 18, and an intermediate voltage generation unit 19. The horizontal driver 16 includes a horizontal shift register 161, a latch circuit 162, and a level shifter/pixel driver 163. The pixel reading shift register 18** is a shift register having a number of stages corresponding to a half of the pixels in one row (i.e., n/2 pixels).

The image display unit 11 includes a plurality of pixels 12 which are regularly arranged. The plurality of pixels 12 are arranged in a two-dimensional matrix at a plurality of intersecting portions where m (m is a natural number equal to or greater than 2) row scanning lines g1 to gm each having one end connected to the vertical shift register 14 and extending in a row direction (X-direction) intersect with n column data lines d1 to dn each having one end connected to the level shifter/pixel driver 163 and extending in a column direction (Y-direction). In the m×n pixels 12, (m×n)/2 pixels 12 which are connected to column data lines in odd-numbered columns are referred to as pixels 12A, and (m×n)/2 pixels 12 which are connected to column data lines in even-numbered columns are referred to as pixels 12B.

One end of all pixels 12A and 12B in the image display unit 11 is commonly connected to trigger lines trig and trigb which are connected to the timing generator 13. A forward trigger pulse TRI transmitted through the forward trigger pulse trigger line trig and a reverse trigger pulse TRIB transmitted through the reverse trigger pulse trigger line trigb are in the relation of reverse logical values (in the complementary relation) all the time.

The timing generator 13 receives, as input signals, external signals such as a vertical synchronizing signal Vst, a horizontal synchronizing signal Hst, and a basic clock CLK, which are output from a higher-level device. Based on these external signals, various internal signals, such as a current-alternating signal FR, a V start pulse VST, an H start pulse HST, clock signals VCK and HCK, a latch pulse LT, trigger pulses TRI and TRIB, and clock signals TCK and TCKB used for the pixel reading shift register 18, are generated.

The current-alternating signal FR is a signal whose polarity is inverted for each subframe, and is supplied, as a common electrode voltage Vcom to be described later, to a common electrode of the liquid crystal display elements in the pixels 12A and 12B constituting the image display unit 11.

The start pulse VST is a pulse signal output at a start timing of each subframe to be described later. This start pulse VST controls switching of each subframe.

The start pulse HST is a pulse signal output to the horizontal shift register 161 at a start timing of the horizontal shift register 161.

The clock signal VCK is a shift clock that specifies one horizontal scanning period (1 V) in the vertical shift register 14. The vertical shift register 14 performs a shift operation at the timing of the clock signal VCK.

The clock signal HCK is a shift clock in the horizontal shift register 161 and is a signal for shifting data with a 32-bit width.

The latch pulse LT is a pulse signal output at a timing when the horizontal shift register 161 completes shifting of data corresponding to a number of pixels in one row in the horizontal direction.

The forward trigger pulse TRI and the reverse trigger pulse TRIB are pulse signals to be supplied to all the pixels 12A and 12B in the image display unit 11 through the trigger lines trig and trigb, respectively.

In this case, the forward trigger pulse TRI and the reverse trigger pulse TRIB are output from the timing generator 13 after data is written into a first data holding unit in all the pixels 12A and 12B within the image display unit 11 in a certain subframe period. Accordingly, in the subframe period, the data held in the first data holding unit in all the pixels 12A and 12B within the image display unit 11 is simultaneously transferred to a second data holding unit in the corresponding one of the pixels 12A and 12B.

The vertical shift register 14 transfers the V start pulse VST, which is supplied at the start timing of each subframe, in accordance with the clock signal VCK, and supplies row scanning signals sequentially and exclusively to the row scanning lines g1 to gm per 1 V. As a result, the row scanning lines are selected in turn one by one per 1 V from the row scanning line g1, which is located at an uppermost position in the image display unit 11, to the row scanning line gm which is located at a lowermost position in the image display unit 11.

The data latch circuit 15 latches 32-bit data for each frame supplied from an external circuit (not shown) based on the basic clock CLK from the higher-level device, and outputs the data to the horizontal shift register 161 in synchronization with the basic clock CLK.

The liquid crystal display device 10 divides one frame of a video signal into a plurality of subframes having a display period shorter than one frame period of the video signal, and performs gradation display with a combination of these subframes. Accordingly, the above-mentioned external circuit converts gradation data indicating the gradation of each pixel into a plurality of pieces of 1-bit subframe data corresponding to the plurality of subframes. Further, the external circuit collectively supplies the data latch circuit 15 with the subframe data corresponding to 32 pixels belonging to the same subframe as the 32-bit data.

When the horizontal shift register 161 is regarded as a 1-bit serial data processing system, the horizontal shift register 161 starts shifting by the start pulse HST which is supplied from the timing generator 13 at the initial time of 1 V, and shifts the 32-bit data, which is supplied from the data latch circuit 15, in synchronization with the clock signal HCK.

After the horizontal shift register 161 completes shifting (n/32 shift clock) of n-bit data corresponding to the pixel number n for one row of the image display unit 11, the latch circuit 162 latches n-bit data (i.e., subframe data corresponding to n pixels in the same row) to be supplied in parallel from the horizontal shift register 161 in synchronization of the latch pulse LT supplied from the timing generator 13, and outputs the data to the level shifter of the level shifter/pixel driver 163. After the data transfer of the latch circuit 162 is completed, the start pulse HST is output from the timing generator 13 again, and the horizontal shift register 161 resumes shifting of the 32-bit data from the data latch circuit 15 in accordance with the clock signal HCK.

The level shifter of the level shifter/pixel driver 163 shifts the signal level of n pieces of subframe data corresponding to n pixels in one row, which are latched and supplied from the latch circuit 162, to a liquid crystal drive voltage. The pixel driver of the level shifter/pixel driver 163 outputs n pieces of subframe data corresponding to n pixels in one row after level shifting to the n column data lines d1 to dn in parallel.

The horizontal shift register 161, the latch circuit 162, and the level shifter/pixel driver 163 constituting the horizontal driver 16 perform output of data to the row of pixels in which the data is written this time within 1 V, and shifting of data on the row of pixels in which the data is written within the next 1 V. In a certain horizontal scanning period, the n pieces of latched subframe data in one row are simultaneously output, as data signals, to the n column data lines d1 to dn in parallel.

In the plurality of pixels 12A and 12B constituting the image display unit 11, n pixels 12A and 12B (n/2 pixels 12A and n/2 pixels 12B) in one row that are selected by the row scanning signal from the vertical shift register 14 sample n pieces of subframe data in one row, which are simultaneously output from the level shifter/pixel driver 163, through the n column data lines d1 to dn, and write the sampled data into the first data holding unit, which is described later, in each of the pixels 12A and 12B.

During pixel inspection, after the adjacent pixels 12A and 12B are rendered conductive, test data is input to one of a pair of column data lines respectively corresponding to the adjacent pixels 12A and 12B, and the test result is output from the other one of the column data lines.

The sense amplifiers 17_1 to 17_*n*/2 are provided so as to correspond to a set of column data lines d1, d2 to d(n−1), and dn, respectively. A switch group (selection circuit) is provided between each of the sense amplifiers 17_1 to 17_*n*/2 and the corresponding set of the column data lines d1, d2 to d(n−1), and dn.

Although the details of operation will be described later, for example, when the test data is input to the column data line d1, which is one of the column data lines d1 and d2, the voltage of the test result output from the other column data line d2 and the intermediate voltage mid generated by the intermediate voltage generation unit 19 are selected by the switch group, and are supplied to both input terminals of the sense amplifier 17_1. Then, the sense amplifier 17_1 amplifies a difference voltage between the voltage of the test result and the intermediate voltage mid to a power supply voltage VDD level or a ground voltage GND level, and outputs the amplified voltage. Alternatively, when the test data is input to the column data line d2, which is the other one of the column data lines d1 and d2, the voltage of the test result output from the column data line d1 and the intermediate voltage mid generated by the intermediate voltage generation unit 19 are selected by the switch group, and are supplied to both input terminals of the sense amplifier 17_1. Then, the sense amplifier 17_1 amplifies the difference voltage between the voltage of the test result and the intermediate voltage mid to the power supply voltage VDD level or the ground voltage GND level. During pixel inspection, a similar operation is performed between the set of column data lines d1, d2 to d(n−1), and dn and the corresponding one of the sense amplifiers 17_1 to **17_*n*/2**.

Figure 2:
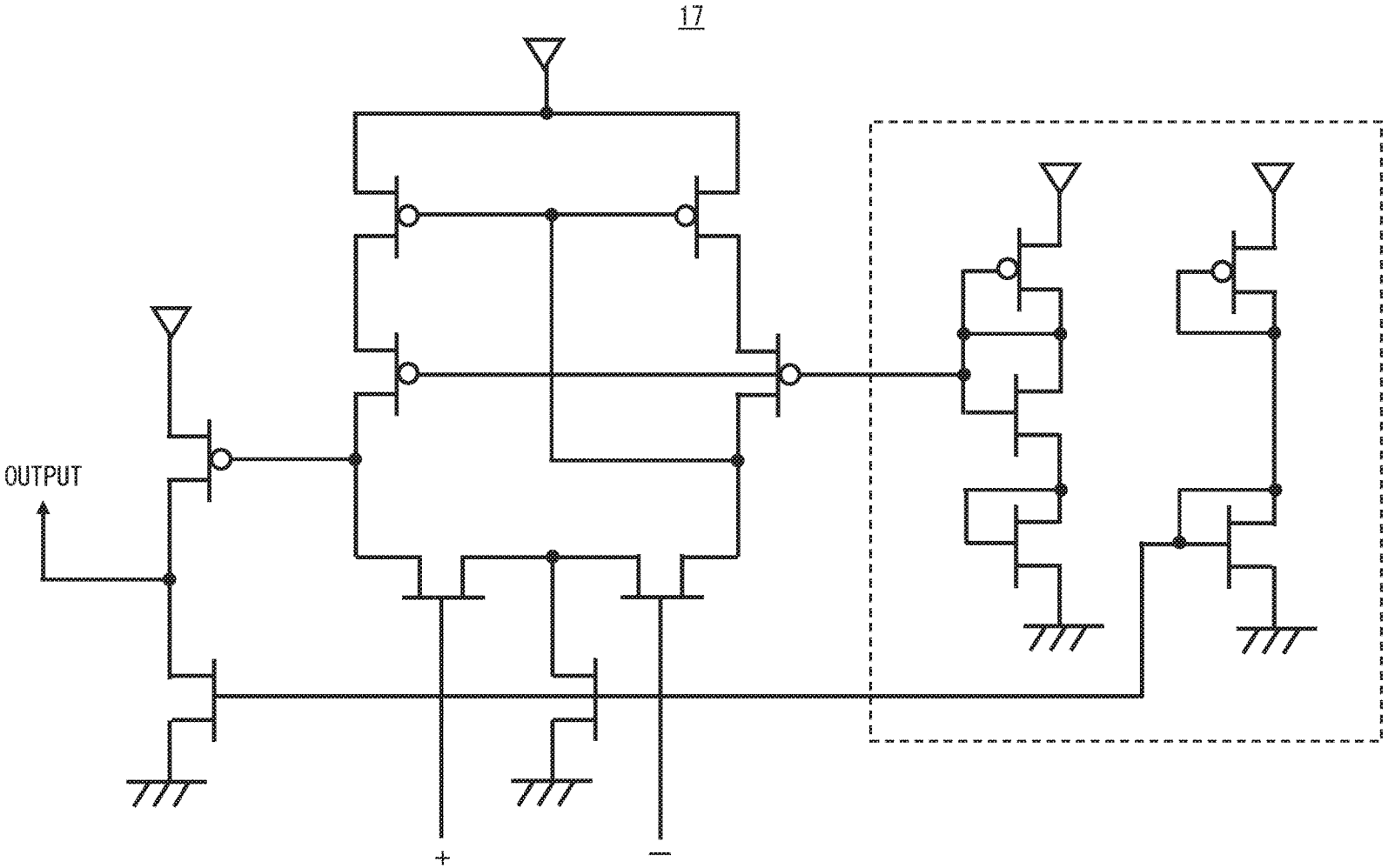
FIG. 2 is a circuit diagram showing a specific configuration of a sense amplifier provided in the liquid crystal display device shown in FIG. 1.

FIG. 2 is a circuit diagram showing a specific configuration of a sense amplifier 17. FIG. 2 also shows a power supply circuit that supplies a power supply voltage to the sense amplifier 17. Referring to FIG. 2, the sense amplifier 17 amplifies the difference voltage between a non-inverted input terminal (+) and an inverted input terminal (−) in the circuit, and outputs the amplified voltage. The power supply circuit forms, by resistance division, an analog voltage (power supply voltage) to be supplied to the sense amplifier 17. The configuration of the sense amplifier 17 is not limited to the configuration shown in FIG. 2, and can be changed as appropriate to a configuration with a higher gain.

The pixel reading shift register 18 latches the amplified test result output from the sense amplifiers 17_1 to **17_*n*/2 during pixel inspection to the pixel reading shift register in synchronization with a latch signal Tlat. Further, the pixel reading shift register 18** serially outputs the test result from an output terminal TOUT in synchronization with the clock signals TCK and TCKB.

(Specific Configurations of Pixels 12A and 12B)

Next, specific configurations of the pixels 12A and 12B will be described.

Figure 3:
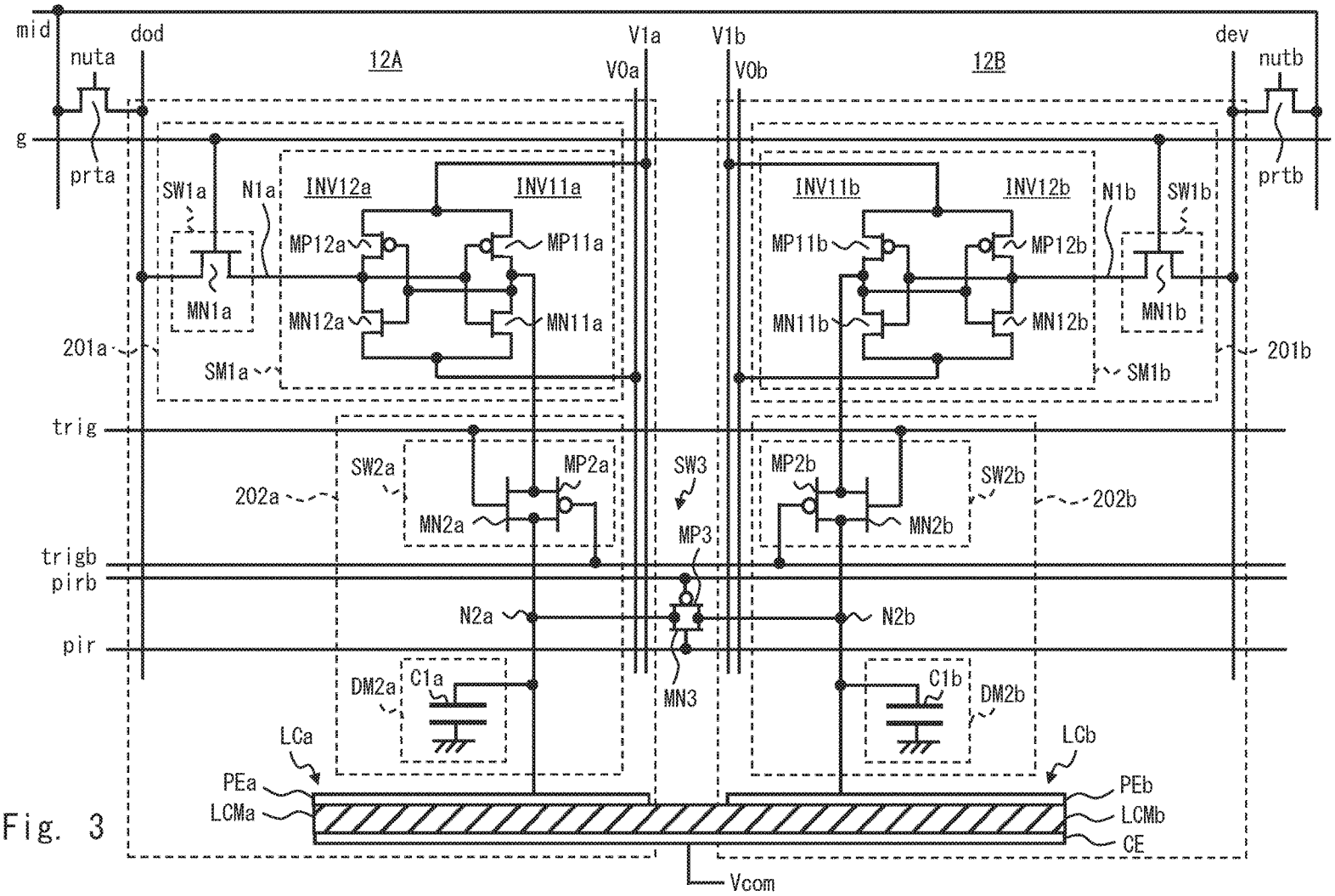
FIG. 3 is a circuit diagram showing specific configurations of a pair of pixels provided in the liquid crystal display device shown in FIG. 1 and peripheral circuits thereof.

FIG. 3 is a circuit diagram showing specific configurations of the pixels 12A and 12B and peripheral circuits thereof.

As shown in FIG. 3, the pixel 12A is provided at an intersecting portion where any one of the row scanning lines g1 to gm (hereinafter referred to as a row scanning line g) and any one of the column data lines in odd-numbered columns (hereinafter referred to as a column data line dod) among the column data lines d1 to dn intersect with each other. The pixel 12B is provided at an intersecting portion where the row scanning line g and any one of the column data lines in even-numbered columns (hereinafter referred to as a column data line dev) among the column data lines d1 to dn intersect with each other.

The pixel 12A includes an SRAM cell 201*a*, a DRAM cell 202*a*, and a liquid crystal display element LCa. The SRAM cell 201*a* is composed of a switch SW1*a* serving as a first switch and a storage unit SM1*a* serving as a first data holding unit. The DRAM cell 202*a* is composed of a switch SW2*a* serving as a second switch and a storage unit DM2*a* serving as a second data holding unit. The liquid crystal display element LCa has a known structure in which a liquid crystal LCMa is filled and encapsulated in a space between reflecting electrodes PEa serving as pixel electrodes, which are arranged separately so as to face each other and have light reflection characteristics, and a common electrode CE having light transmittivity.

The pixel 12B includes an SRAM cell 201*b*, a DRAM cell 202*b*, and a liquid crystal display element LCb. The SRAM cell 201*b* is composed of a switch SW1*b* serving as a first switch and a storage unit SM1*b* serving as a first data holding unit. The DRAM cell 202*b* is composed of a switch SW2*b* serving as a second switch and a storage unit DM2*b* serving as a second data holding unit. The liquid crystal display element LCb has a known structure in which a liquid crystal LCMb is filled and encapsulated in a space between reflecting electrodes PEb serving as pixel electrodes, which are arranged separately so as to face each other and have light reflection characteristics, and the common electrode CE having light transmittivity.

(Configuration of SRAM Cell 201*a*)

The switch SW1*a* is composed of, for example, an N-channel MOS transistor (hereinafter referred to as an NMOS transistor) MN1*a*. The NMOS transistor MN1*a* constituting the switch SW1*a* has a source connected to an input terminal (node N1*a*) of the storage unit SM1*a*, a drain connected to the column data line dod, and a gate connected to the row scanning line g.

The storage unit SM1*a* is a self-holding memory which is composed of two inverters INV11*a* and INV12*a* and has a configuration in which an output terminal of one of the inverters is connected to an input terminal of the other one of the inverters. More specifically, an input terminal of the inverter INV11*a* is connected to each of an output terminal of the inverter INV12*a* and the source of the NMOS transistor MN1*a* constituting the switch SW1*a*. An input terminal of the inverter INV12*a* is connected to each of the switch SW2*a* and an output terminal of the inverter INV11*a*.

Figure 4:
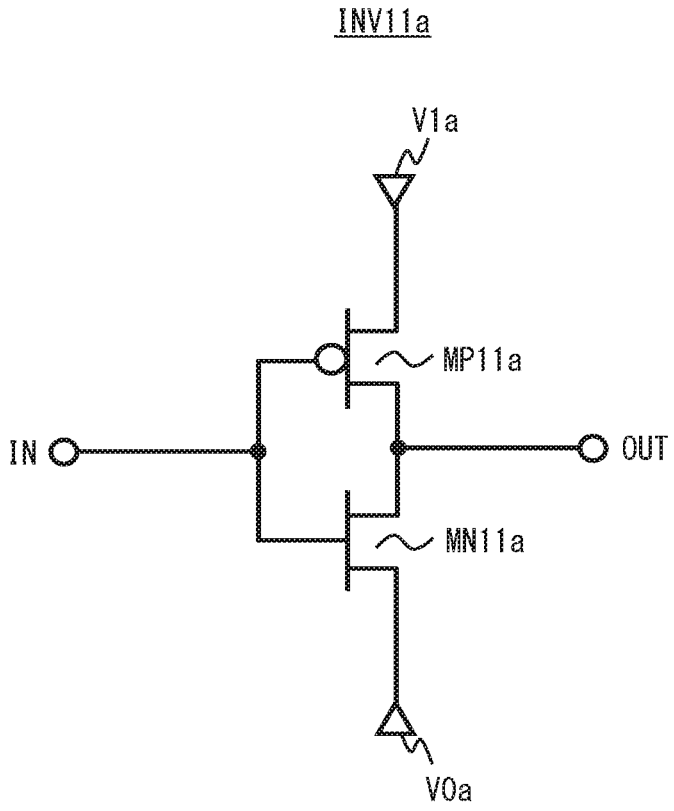
FIG. 4 is a circuit diagram showing a specific configuration of an inverter that constitutes a first data holding unit provided in one of pixels shown in FIG. 3.

FIG. 4 is a circuit diagram showing a specific configuration of the inverter INV11*a*.

Referring to FIG. 4, the inverter INV11*a* includes a P-channel MOS transistor (hereinafter referred to as a PMOS transistor) MP11*a* and an NMOS transistor MN11*a* which are connected in series. The inverter INV11*a* is a known CMOS inverter that inverts an input signal supplied to the gate of each transistor and outputs the inverted signal to the drain of each transistor. The inverter INV11*a* operates when a voltage (operating voltage) is supplied to a high-potential-side voltage terminal and a low-potential-side voltage terminal.

Similarly, the inverter INV12*a* includes PMOS transistors MP12*a* and MN12*a* which are connected in series. The inverter INV12*a* is a known CMOS inverter that inverts the input signal supplied to the gate of each transistor and outputs the inverted signal to the drain of each transistor. The inverter INV12*a* operates when a voltage (operating voltage) is supplied to the high-potential-side voltage terminal and the low-potential-side voltage terminal.

Source electrodes of the PMOS transistors MP11*a* and MP12*a* serve as the high-potential-side voltage terminals of the inverters INV11*a* and INV12*a*, respectively, and are each connected to a high-potential-side power supply line V1*a*. Source electrodes of the NMOS transistors MN11*a* and MN12*a* serve as the low-potential-side voltage terminals of the inverters INV11*a* and INV12*a*, respectively, and are each connected to a low-potential-side power supply line V0*a*.

In this case, the inverters INV11*a* and INV12*a* have different drive capabilities. Specifically, in the inverters INV11*a* and INV12*a* constituting the storage unit SM1*a*, the drive capability of the transistors MP11*a* and MN11*a* in the inverter INV11*a*, which is the input side as viewed from the switch SW1*a*, is larger than the drive capability of the transistors MP12*a* and MN12*a* in the inverter INV12*a* which is the output side as viewed from the switch SW1*a*. With this configuration, data can be easily transmitted to the storage unit SM1*a* from the column data line dod through the switch SW1*a*, while data is less likely to be transmitted from the storage unit DM2*a* to the storage unit SM1*a* through the switch SW2*a*.

Further, the drive capability of the NMOS transistor MN1*a* constituting the switch SW1*a* is larger than the drive capability of the NMOS transistor MN12*a* constituting the inverter INV12*a*. Accordingly, for example, when data indicating H-level on the column data line dod is stored in the storage unit SM1*a*, a current flowing from the column data line dod to the input terminal (node N1*a*) of the storage unit SM1*a* through the switch SW1*a* is larger than a current flowing from the input terminal of the storage unit SM1*a* to the low-potential-side power supply line V0*a* through the NMOS transistor MN12*a*. Therefore, the data can be accurately stored in the storage unit SM1*a*.

(Configuration of SRAM Cell 201*b*)

The switch SW1*b* is composed of, for example, an NMOS transistor MN1*b*. The NMOS transistor MN1*b* constituting the switch SW1*b* has a source connected to an input terminal (node N1*b*) of the storage unit SM1*b*, a drain connected to the column data line dev, and a gate connected to the row scanning line g.

The storage unit SM1*b* is a self-holding memory which is composed of two inverters INV11*b* and INV12*b* and has a configuration in which an output terminal of one of the inverters is connected to an input terminal of the other one of the inverters. More specifically, an input terminal of the inverter INV11*b* is connected to each of an output terminal of the inverter INV12*b* and the source of the NMOS transistor MN1*b* constituting the switch SW1*b*. An input terminal of the inverter INV12*b* is connected to each of the switch SW2*b* and an output terminal of the inverter INV11*b*.

The inverter INV11*b* includes PMOS transistors MP11*b* and MN11*b* which are connected in series. The inverter INV11*b* is a known CMOS inverter that inverts an input signal supplied to the gate of each transistor and outputs the inverted signal from the drain of each transistor. The inverter INV11*b* operates when a voltage (operating voltage) is supplied to each of the high-potential-side voltage terminal and the low-potential-side voltage terminal.

Similarly, the inverter INV12*b* includes PMOS transistors MP12*b* and MN12*b* which are connected in series. The inverter INV12*b* is a known CMOS inverter that inverts an input signal supplied to the gate of each transistor and outputs the inverted signal from the drain of each transistor. The inverter INV12*b* operates when a voltage (operating voltage) is supplied to each of the high-potential-side voltage terminal and the low-potential-side voltage terminal.

Source electrodes of the PMOS transistors MP11*b* and MP12*b* serve as the high-potential-side voltage terminals of the inverters INV11*b* and INV12*b*, respectively, and are each connected to a high-potential-side power supply line V1*b*. Source electrodes of the NMOS transistors MN11*b* and MN12*b* serve as the low-potential-side voltage terminals of the inverters INV11*b* and INV12*b*, respectively, and are each connected to a low-potential-side power supply line V0*b*.

In this case, the inverters INV11*b* and INV12*b* have different drive capabilities. Specifically, in the inverters INV11*b* and INV12*b* constituting the storage unit SM1*b*, the drive capability of the transistors MP11*b* and MN11*b* in the inverter INV11*b*, which is the input side as viewed from the switch SW1*b*, is larger than the drive capability of the transistors MP12*b* and MN12*b* in the inverter INV12*b* which is the output side as viewed from the switch SW1*b*. With this configuration, data can be easily transmitted to the storage unit SM1*b* from the column data line dev through the switch SW1*b*, while data is less likely to be transmitted from the storage unit DM2*b* to the storage unit SM1*b* through the switch SW2*b*.

Further, the drive capability of the NMOS transistor MN1*b* constituting the switch SW1*b* is larger than the drive capability of the NMOS transistor MN12*b* constituting the inverter INV12*b*. Accordingly, for example, when data indicating H-level on the column data line dev is stored in the storage unit SM1*b*, a current flowing from the column data line dev to the input terminal (node N1*b*) of the storage unit SM1*b* through the switch SW1*b* is larger than a current flowing from the input terminal of the storage unit SM1*b* to the low-potential-side power supply line V0*b* through the NMOS transistor MN12*b*. Therefore, the data can be accurately stored in the storage unit SM1*b*.

In this case, the high-potential-side power supply line V1*a* and the low-potential-side power supply line V0*a* are connected to all the pixels 12A. The high-potential-side power supply line V1*b* and the low-potential-side power supply line V0*b* are connected to all the pixels 12B. Thus, the operating voltage to be supplied to the inverters constituting the storage unit of the SRAM cell in each pixel 12A can be made different from the operating voltage to be supplied to the inverters constituting the storage unit of the SRAM cell in each pixel 12B. For example, during pixel inspection, the high-potential-side power supply lines V1*a* and V1*b* are supplied with different voltages and the low-potential-side power supply lines V0*a* and V0*b* are supplied with different voltages. On the other hand, during a normal operation, the high-potential-side power supply lines V1*a* and V1*b* are supplied with the same potential (power supply voltage VDD level) and the low-potential-side power supply lines V0*a* and V0*b* are supplied with the same potential (ground voltage GND level).

(Configuration of DRAM Cell 202*a*)

The switch SW2*a* is a known transmission gate composed of an NMOS transistor MN2*a* and a PMOS transistor MP2*a* which are connected in parallel. More specifically, the sources of the NMOS transistor MN2*a* and the PMOS transistor MP2*a* are commonly connected to an output terminal of the storage unit SM1*a*, and the drains (node N2*a*) of the NMOS transistor MN2*a* and the PMOS transistor MP2*a* are commonly connected to an input terminal of the storage unit DM2*a* and the reflecting electrode PEa of the liquid crystal display element LCa. Further, the gate of the NMOS transistor MN2*a* is connected to the forward trigger pulse trigger line trig, and the gate of the PMOS transistor MP2*a* is connected to the reverse trigger pulse trigger line trigb.

For example, the switch SW2*a* is turned on when the forward trigger pulse supplied through the trigger line trig is at H-level (the reverse trigger pulse supplied through the trigger line trigb is at L-level), and transfers the data read out from the storage unit SM1*a* to each of the storage unit DM2*a* and the reflecting electrode PEa. The switch SW2*a* is turned off when the forward trigger pulse supplied through the trigger line trig is at L-level (the reverse trigger pulse supplied through the trigger line trigb is at H-level), and does not read out the data stored in the storage unit SM1*a*.

Since the switch SW2*a* is a known transmission gate, the switch SW2*a* is capable of transferring a wide range of voltage from the ground voltage GND to the power supply voltage VDD in the ON state. More specifically, when the voltage applied to the sources of the transistors MN2*a* and MP2*a* from the storage unit SM1*a* is at the power supply voltage VDD level (H-level), the source and the drain of the PMOS transistor MP2*a* are not rendered conductive, but instead the source and the drain of the NMOS transistor MN2*a* can be rendered conductive with low resistance. On the other hand, when the voltage applied to the sources of the transistors MN2*a* and MP2*a* from the storage unit SM1*a* is at the ground voltage GND level (L-level), the source and the drain of the NMOS transistor MN2*a* are not rendered conductive, but instead the source and the drain of the PMOS transistor MP2*a* can be rendered conductive with low resistance. Thus, in the switch SW2*a*, the source and the drain of the transmission gate can be rendered conductive with low resistance, so that a wide range of voltage from the ground voltage GND to the power supply voltage VDD can be transferred in the ON state.

The storage unit DM2*a* is composed of a capacitance C1*a*. As the capacitance C1*a*, for example, a MIM (Metal Insulator Metal) capacitance forming a capacitance between lines, a Diffusion capacitance forming a capacitance between a substrate and polysilicon, a PIP (Poly Insulator Poly) capacitance forming a capacitance between two polysilicon layers, or the like can be used.

In a case where the data stored in the storage unit SM1*a* and the data stored in the capacitance C1*a* are different, when the switch SW2*a* is turned on and the data stored in the storage unit SM1*a* is transferred to the capacitance C1*a*, the data held in the capacitance C1*a* needs to be overwritten with the data stored in the storage unit SM1*a*.

When the data held in the capacitance C1*a* is overwritten, the data held in the capacitance C1*a* is changed by charging/discharging of the capacitance C1*a*, and charging/discharging of the capacitance C1*a* is driven by an output signal from the inverter INV11*a*.

Specifically, when the data held in the capacitance C1*a* is changed from L-level to H-level by charging, the output signal from the inverter INV11*a* is first changed from L-level to H-level. At this time, the PMOS transistor MP11*a* constituting the inverter INV11*a* is turned on and the NMOS transistor MP12*a* is turned off. Accordingly, the capacitance C1*a* is charged with a voltage (hereinafter referred to as a voltage V1*a*) from the high-potential-side power supply line V1*a* which is connected to the source of the PMOS transistor MP11*a* of the inverter INV11*a*.

On the other hand, when the data held in the capacitance C1*a* is changed from H-level to L-level by discharging, the output signal from the inverter INV11*a* is first changed from H-level to L-level. At this time, the NMOS transistor MN11*a* constituting the inverter INV11*a* is turned on and the PMOS transistor MP11*a* is turned off. Accordingly, the electric charge accumulated in the capacitance C1*a* is discharged by a voltage (hereinafter referred to as a voltage V0*a*) from the low-potential-side power supply line V0*a* which is connected to the source of the NMOS transistor MN11*a* of the inverter INV11*a*.

Since the switch SW2*a* is composed of an analog switch using the transmission gate as described above, it is possible to charge and discharge the capacitance C1*a* at high speed. Further, in the first exemplary embodiment, the drive capability of the inverter INV11*a* is set to be larger than the drive capability of the inverter INV12*a*, so that it is possible to charge and discharge the capacitance C1*a* at higher speed.

In this case, when the switch SW2*a* is turned on, the electric charge stored in the capacitance C1*a* affects the input gate of the inverter INV12*a*. However, since the drive capability of the inverter INV11*a* is set to be larger than the drive capability of the inverter INV12*a*, priority is given to charging/discharging of the capacitance C1*a* by the inverter INV11*a* over the inversion of the data input by the inverter INV12*a*. This prevents unintentional overwriting of the data stored in the storage unit SM1*a* due to the electric charge stored in the capacitance C1*a*.

(Configuration of DRAM Cell 202*b*)

The switch SW2*b* is a known transmission gate composed of an NMOS transistor MN2*b* and a PMOS transistor MP2*b* which are connected in parallel. More specifically, the sources of the NMOS transistor MN2*b* and the PMOS transistor MP2*b* are commonly connected to an output terminal of the storage unit SM1*b*, and the drains (node N2*b*) of the NMOS transistor MN2*b* and the PMOS transistor MP2*b* are commonly connected to an input terminal of the storage unit DM2*b* and the reflecting electrode PEb of the liquid crystal display element LCb. The gate of the NMOS transistor MN2*b* is connected to the forward trigger pulse trigger line trig, and the gate of the PMOS transistor MP2*b* is connected to the reverse trigger pulse trigger line trigb.

For example, the switch SW2*b* is turned on when the forward trigger pulse supplied through the trigger line trig is at H-level (the reverse trigger pulse supplied through the trigger line trigb is at L-level), and transfers the data read out from the storage unit SM1*b* to each of the storage unit DM2*b* and the reflecting electrode PEb. The switch SW2*b* is turned off when the forward trigger pulse supplied through the trigger line trig is at L-level (the reverse trigger pulse supplied through the trigger line trigb is at H-level), and does not read out the data stored in the storage unit SM1*b*.

Since the switch SW2*b* is a known transmission gate, the switch SW2*b* is capable of transferring a wide range of voltage from the ground voltage GND to the power supply voltage VDD in the ON state. More specifically, when the voltage applied to the sources of the transistors MN2*b* and MP2*b* from the storage unit SM1*b* is at the power supply voltage VDD level (H-level), the source and the drain of the PMOS transistor MP2*b* are not rendered conductive, but instead the source and the drain of the NMOS transistor MN2*b* can be rendered conductive with low resistance. On the other hand, when the voltage applied to the sources of the transistors MN2*b* and MP2*b* from the storage unit SM1*b* is at the ground voltage GND level (L-level), the source and the drain of the NMOS transistor MN2*b* are not rendered conductive, but instead the source and the drain of the PMOS transistor MP2*b* can be rendered conductive with low resistance. Thus, in the switch SW2*b*, the source and the drain of the transmission gate can be rendered conductive with low resistance, so that a wide range of voltage from the ground voltage GND to the power supply voltage VDD can be transferred in the ON state.

The storage unit DM2*b* is composed of a capacitance C1*b*. As the capacitance C1*b*, for example, a MIM (Metal Insulator Metal) capacitance forming a capacitance between lines, a Diffusion capacitance forming a capacitance between a substrate and polysilicon, a PIP (Poly Insulator Poly) capacitance forming a capacitance between two polysilicon layers, or the like can be used.

In a case where the data stored in the storage unit SM1*b* and the data stored in the capacitance C1*b* are different, when the switch SW2*b* is turned on and the data stored in the storage unit SM1*b* is transferred to the capacitance C1*b*, the data held in the capacitance C1*b* needs to be overwritten with the data stored in the storage unit SM1*b*.

When the data held in the capacitance C1*b* is overwritten, the data held in the capacitance C1*b* is changed by charging/discharging of the capacitance C1*b*, and charging/discharging of the capacitance C1*b* is driven by an output signal from the inverter INV11*b*.

Specifically, when the data held in the capacitance C1*b* is changed from L-level to H-level by charging, the output signal from the inverter INV11*b* is first changed from L-level to H-level. At this time, the PMOS transistor MP11*b* constituting the inverter INV11*b* is turned on and the NMOS transistor MP12*b* is turned off. Accordingly, the capacitance C1*b* is charged with a voltage (hereinafter referred to as a voltage V1*b*) from the high-potential-side power supply line V1*b* which is connected to the source of the PMOS transistor MP11*b* of the inverter INV11*b*.

On the other hand, when the data held in the capacitance C1*b* is changed from H-level to L-level by discharging, the output signal from the inverter INV11*b* is first changed from H-level to L-level. At this time, the NMOS transistor MN11*b* constituting the inverter INV11*b* is turned on and the PMOS transistor MP11*b* is turned off. Accordingly, the electric charge accumulated in the capacitance C1*b* is discharged by a voltage (hereinafter referred to as a voltage V0*b*) from the low-potential-side power supply line V0*b* which is connected to the source of the NMOS transistor MN11*b* of the inverter INV11*b*.

Since the switch SW2*b* is composed of an analog switch using the transmission gate as described above, it is possible to charge and discharge the capacitance C1*b* at high speed. Further, in the first exemplary embodiment, the drive capability of the inverter INV11*b* is set to be larger than the drive capability of the inverter INV12*b*, so that it is possible to charge and discharge the capacitance C1*b* at higher speed.

In this case, when the switch SW2*b* is turned on, the electric charge stored in the capacitance C1*b* affects the input gate of the inverter INV12*b*. However, since the drive capability of the inverter INV11*b* is set to be larger than the drive capability of the inverter INV12*b*, priority is given to charging/discharging of the capacitance C1*b* by the inverter INV11*b* over the inversion of the data input by the inverter INV12*b*. This prevents unintentional overwriting of the data stored in the storage unit SM1*b* due to the electric charge stored in the capacitance C1*b*.

In the first exemplary embodiment, in the transistors MN11*a*, MN12*a*, MN11*b*, and MN12*b*, a voltage (for example, the ground voltage GND of 0 V) to be supplied to each well electrode is different from a voltage (voltage V0*a* or V0*b*) to be supplied to each source electrode. Further, in the transistors MP11*a*, MP12*a*, MP11*b*, and MP12*b*, a voltage (for example, the power supply voltage VDD of 3.3 V) to be supplied to each well electrode is different from a voltage (voltage V1*a* or V1*b*) to be supplied to each source electrode. As described above, the voltage V0*a* and the voltage V0*b* can be individually set by, for example, the higher-level device. Also, the voltage V1*a* and the voltage V1*b* can be individually set by, for example, the higher-level device.

For example, when the voltages V0*a* and V0*b* are 0.5 V and the voltages V1*a* and V1*b* are 2.8 V, data having an amplitude (voltage range) of 3.3 V is input to the pixels 12A and 12B through the column data lines dod and dev, respectively. After that, when the switches SW1*a* and SW1*b* are turned off and the data is latched by the storage units SM1*a* and SM1*b*, the amplitude of the data latched by the storage units SM1*a* and SM1*b* is 2.3 V (=2.8 V−0.5 V). Then, when the switches SW2*a* and SW2*b* are turned on and the data latched by the storage units SM1*a* and SM1*b* are transferred to the storage units DM2*a* and DM2*b*, respectively, 1-bit digital data having an amplitude of 2.3 V is applied to the reflecting electrodes PEa and PEb.

Thus, the liquid crystal display device 10 according to the first exemplary embodiment uses the pixels 12A and 12B each including one SRAM cell and one DRAM cell to reduce the number of transistors constituting each pixel, in comparison with the case of using pixels each including two SRAM cells, thereby achieving the miniaturization of pixels.

The first exemplary embodiment illustrates an example in which each of the switches SW2*a* and SW2*b* is a transmission gate, but the configuration of each of the switches SW2*a* and SW2*b* is not limited to the transmission gate. The configuration of each of the switches SW2*a* and SW2*b* can be changed as appropriate to a configuration in which one of a PMOS transistor and an NMOS transistor is provided. In this case, only one of the trigger lines trig and trigb is provided.

The liquid crystal display device 10 can achieve the miniaturization of pixels not only by reducing the number of transistors constituting each pixel, but also by effectively arranging the storage units SM1*a*, SM1*b*, DM2*a*, and DM2*b* and the reflecting electrodes PEa and PEb in the element height direction as described below. The details thereof will be described below with reference to FIG. 5.

(Sectional Structure of Pixel 12A)

Figure 5:
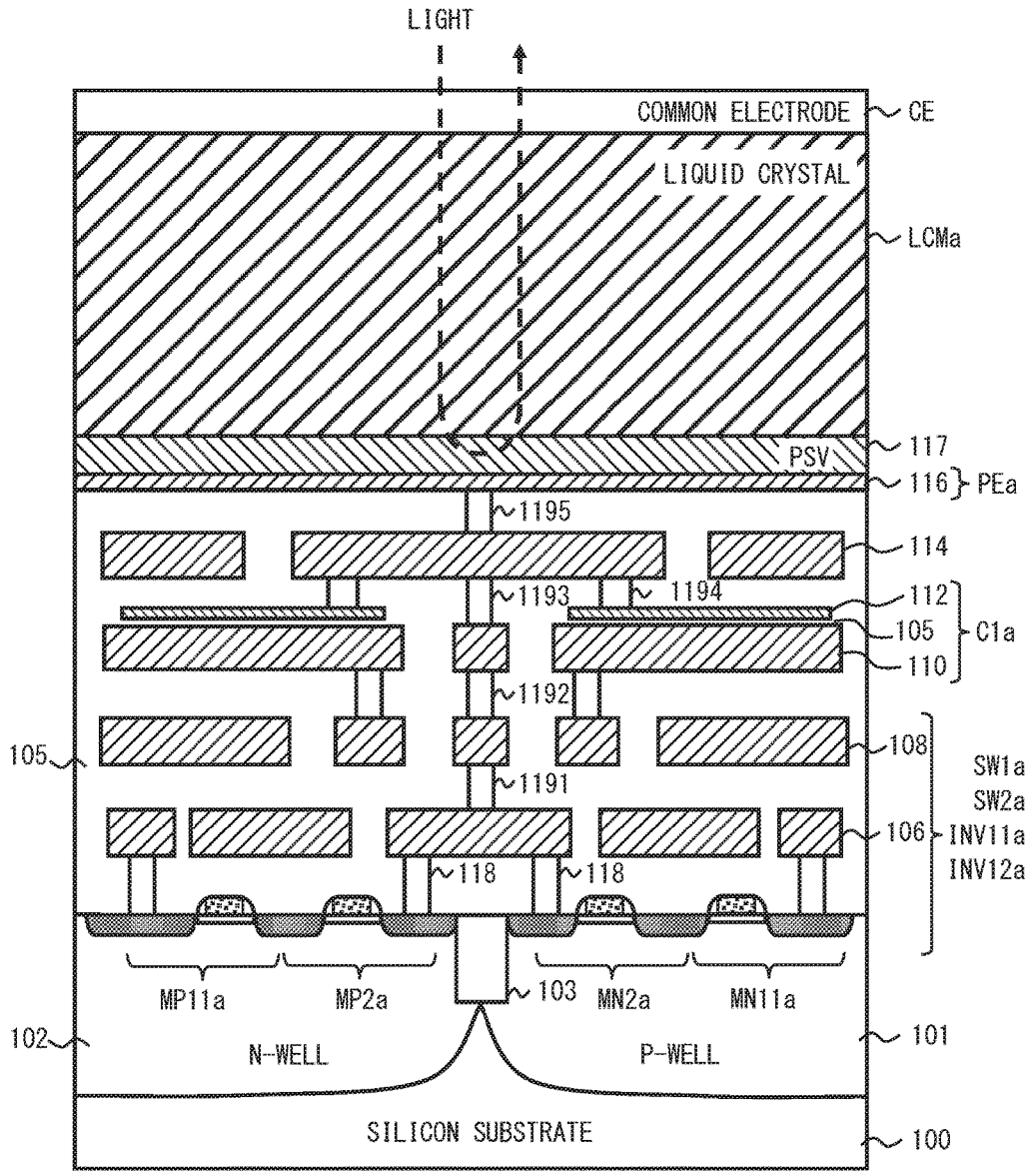
FIG. 5 is a schematic sectional view of one pixel shown in FIG. 3.

FIG. 5 is a schematic sectional view showing a major part of the pixel 12A. FIG. 5 illustrates an example in which the capacitance C1*a* is composed of a MIM capacitance forming a capacitance between lines. A sectional structure of the pixel 12B is basically similar to that of the pixel 12A, and thus the description thereof is omitted.

As shown in FIG. 5, an N-well 102 and a P-well 101 are formed on a silicon substrate 100.

The PMOS transistor MP2*a* of the switch SW2*a* and the PMOS transistor MP11*a* of the inverter INV11*a* are formed on the N-well 102. More specifically, a common diffusion layer serving as the source of the PMOS transistor MP2*a* and the drain of the PMOS transistor MP11*a*, and two diffusion layers serving as the drain of the PMOS transistor MP2*a* and the source of the PMOS transistor MP11*a*, respectively, are formed on the N-well 102. On a channel region between the common diffusion layer and the two diffusion layers, polysilicon layers serving as the gates of the PMOS transistors MP2*a* and MP11*a*, respectively, are formed with a gate oxide film disposed therebetween.

The NMOS transistor MN2*a* of the switch SW2*a* and the NMOS transistor MN11*a* of the inverter INV11*a* are formed on the P-well 101. More specifically, a common diffusion layer serving as the source of the NMOS transistor MN2*a* and the drain of the NMOS transistor MN11*a*, and two diffusion layers serving as the drain of the NMOS transistor MN2*a* and the source of the NMOS transistor MN11*a*, respectively, are formed on the P-well 101. On a channel region between the common diffusion layer and the two diffusion layers, polysilicon layers serving as the gates of the NMOS transistors MN2*a* and MN11*a*, respectively, are formed with a gate oxide film disposed therebetween. Note that in FIG. 5, the illustration of the PMOS transistor MP12*a* and the NMOS transistor MN12*a* which constitute the inverter INV12*a* is omitted.

An isolation oxide film 103 is formed between an active region (the diffusion layer and the channel region) on the N-well and an active region on the P-well.

Above the transistors MP2*a*, MP11*a*, MN2*a*, and MN11*a*, a first metal 106, a second metal 108, a third metal 110, a capacitance electrode 112, a fourth metal 114, and a fifth metal 116 are formed with an interlayer insulating film 105 interposed between the metals.

The fifth metal 116 forms the reflecting electrode PEa which is formed in each pixel.

The diffusion layers forming the drains of the transistors MN2*a* and MP2*a*, respectively, are electrically connected to the fifth metal 116, which forms the reflecting electrode PEa, through contacts 118, the first metal 106, a through-hole 1191, the second metal 108, a through-hole 1192, the third metal 110, a through-hole 1193, the fourth metal 114, and a through-hole 1195. Further, the diffusion layers forming the drains of the transistors MN2*a* and MP2*a*, respectively, are electrically connected to the capacitance electrode 112 through the contacts 118, the first metal 106, the through-hole 1191, the second metal 108, the through-hole 1192, the third metal 110, the through-hole 1193, the fourth metal 114, and a through-hole 1194. In other words, the drains of the transistors MN2*a* and MP2*a* constituting the switch SW2*a* are electrically connected to the reflecting electrode PEa and the capacitance electrode 112.

The reflecting electrode PEa (fifth metal 116) is opposed to and spaced apart from the common electrode CE, which is a transparent electrode, through a passivation film (PSV) 117 which is a protective film formed on the upper surface of the reflecting electrode PEa. The LCMa is filled and encapsulated in a space between the reflecting electrode PEa and the common electrode CE. The reflecting electrode PEa, the common electrode CE, and the liquid crystal LCMa disposed therebetween constitute the liquid crystal display element LCa.

In this case, the capacitance electrode 112 constituting the MIM is formed above the third metal 110 with the interlayer insulating film 105 disposed therebetween. The capacitance electrode 112, the third metal 110, and the interlayer insulating film 105 formed therebetween constitute the capacitance C1*a*. Thus, the switches SW1*a* and SW2*a* and the storage unit SM1*a* are formed using the first metal 106 and the second metal 108, which are first and second layer lines, and transistors, while the storage unit DM2*a* is formed using the third metal 110, which is a layer formed above the first and second layer lines, and the capacitance electrode 112. In other words, the layer in which the switches SW1*a* and SW2*a* and the storage unit SM1*a* are formed is different from the layer in which the storage unit DM2*a* is formed.

Light from a light source (not shown) is transmitted through the common electrode CE and the liquid crystal LCMa, and is incident on the reflecting electrode PEa (fifth metal 116) and reflected by the reflecting electrode PEa. Then, the light is returned through the original incident path and output through the common electrode CE.

In this manner, the liquid crystal display device 10 uses the fifth metal 116, which is a fifth layer line, as the reflecting electrode PEa; the third metal 110, which is a third layer line, as a part of the storage unit DM2*a*; and the first and second metals 106 and 108, which are first and second layer lines, and transistors as the storage unit SM1*a* and the like, thereby making it possible to effectively arrange the storage unit SM1*a*, the storage unit DM2*a*, and the reflecting electrode PEa in the height direction. This enables further miniaturization of pixels. Thus, for example, pixels having a pitch of 3 μm or less can be formed using a transistor with a power supply voltage of 3.3 V. The use of pixels having a pitch of 3 μm or less makes it possible to achieve a liquid crystal panel having 4,000 pixels crosswise and 2,000 pixels lengthwise in a diagonal length of 0.55 inches.

(Normal Operation of Liquid Crystal Display Device 10)

Next, the normal operation of the liquid crystal display device 10 will be described with reference to FIG. 6.

Figure 6:
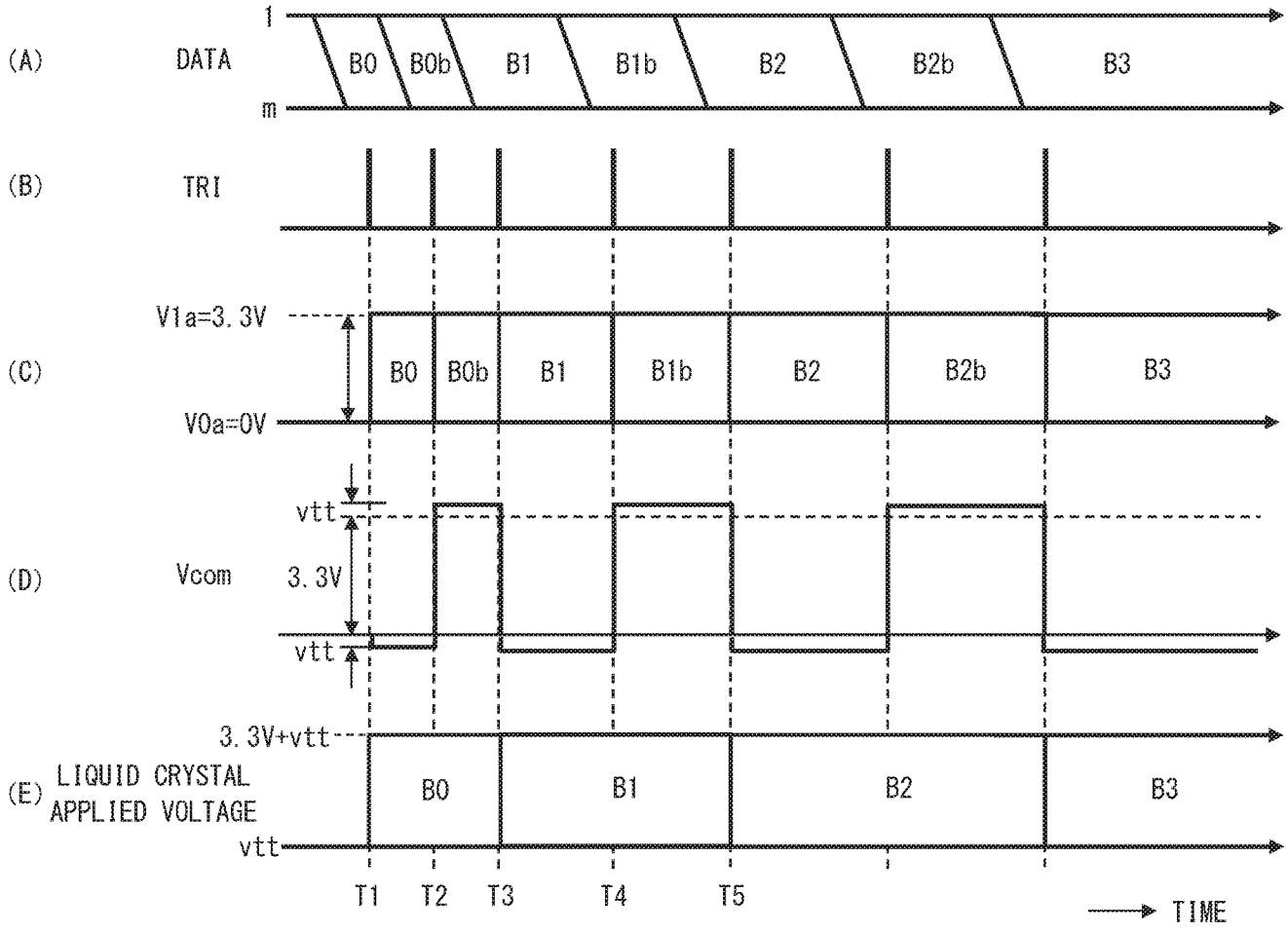
FIG. 6 is a timing diagram showing a normal operation of the liquid crystal display device shown in FIG. 1.

FIG. 6 is a timing diagram showing the normal operation of the liquid crystal display device 10.

As described above, in the liquid crystal display device 10, the row scanning lines g1 to gm are selected in turn one by one per 1 V by the row scanning signal from the vertical shift register 14. Accordingly, data is written into the plurality of pixels 12A and 12B, which constitute the image display unit 11, in units of n pixels in one row commonly connected to the selected row scanning line. After the data is written into all the storage units SM1*a* and SM1*b* in the plurality of pixels 12A and 12B constituting the image display unit 11, the data stored in the storage units SM1*a* and SM1*b* in all the pixels 12A and 12B are simultaneously transferred to the capacitances C1*a* and C1*b* and the reflecting electrodes PEa and PEb based on the trigger pulses TRI and TRIB.

FIG. 6(A) shows a change of subframe data stored in each of the pixels 12A and 12B. Note that the vertical axis represents a row number and the horizontal axis represents time. As shown in FIG. 6(A), each boundary between the subframe data is a downward-sloping line. This indicates that the larger the row number of a pixel is, the longer the timing of writing subframe data into the pixel is delayed. A period from one end of the boundary to the other end thereof corresponds to a subframe data write period. Note that B0*b*, B1*b*, and B2*b* respectively represent the inverted data of subframe data of bits B0, B1, and B2.

FIG. 6(B) shows an output timing (rise timing) of the trigger pulse TRI. Since the trigger pulse TRI constantly indicates the logically inverted value of the trigger pulse TRI, the illustration of the trigger pulse TRIB is omitted. FIG. 6(C) schematically shows bits of subframe data applied to the reflecting electrodes PEa and PEb. FIG. 6(D) shows a change in the value of the common electrode voltage Vcom. FIG. 6(E) shows a change of the voltage applied to the liquid crystals LCMa and LCMb.

First, in the pixel 12A out of the pixels 12A and 12B selected by the row scanning signal, the switch SW1*a* is turned on, so that forward subframe data of the bit B0 output from the horizontal driver 16 to the column data line dod is sampled by the switch SW1*a* and written into the storage unit SM1*a*. On the other hand, in the pixel 12B, the switch SW1*b* is turned on, so that forward subframe data of the bit B0 output from the horizontal driver 16 to the column data line dev is sampled by the switch SW1*b* and written into the storage unit SM1*b*.

Similarly, the forward subframe data of the bit B0 is written into the storage units SM1*a* and SM1*b* of all the pixels 12A and 12B constituting the image display unit 11. After that, the H-level trigger pulse TRI (and the L-level trigger pulse TRIB) is supplied to all the pixels 12A and 12B, which constitute the image display unit 11, at the same time (time T1).

As a result, the switches SW2*a* and SW2*b* of all the pixels 12A and 12B are turned on. Accordingly, the forward subframe data of the bit B0 stored in the storage units SM1*a* and SM1*b* is simultaneously transferred and held in the capacitances C1*a* and C1*b* through the switches SW2*a* and SW2*b*, and is applied to the reflecting electrodes PEa and PEb. As seen from FIG. 6(C), the period in which the forward subframe data of the bit B0 is held by the capacitances C1*a* and C1*b* (the period in which the forward subframe data of the bit B0 is applied to the reflecting electrodes PEa and PEb) corresponds to one subframe period from the time (time T1) when the trigger pulse TRI becomes H-level to the time (time T2) when the trigger pulse TRI becomes H-level next time.

In this case, when the bit value of the subframe data is "1", i.e., when the subframe data is at H-level, the voltages V1*a* and V1*b* of the power supply voltage VDD level (for example, 3.3 V) are applied to the reflecting electrodes PEa and PEb. When the bit value of the subframe data is "0", i.e., when the subframe data is at L-level, the voltages V0*a* and V0*b* of the ground voltage GND level (for example, 0 V) are applied to the reflecting electrodes PEa and PEb. At this time, as described above, the voltages V1*a* and V1*b* of the same potential are used and the voltages V0*a* and V0*b* of the same potential are used. Note that the voltages V1*a* and V1*b* are not limited to 3.3 V and the voltages V0*a* and V0*b* are not limited to 0 V. The voltages V1*a* and V1*b* and the voltages V0*a* and V0*b* can be set to any voltage level depending on the characteristics of liquid crystal and process variations.

The voltage to be applied to the common electrode CE is not limited to the ground voltage GND and the power supply voltage VDD, and an arbitrary voltage can be applied as the common electrode voltage Vcom. The common electrode voltage Vcom is controlled to be switched to a predetermined voltage in synchronization with the input of the H-level forward trigger pulse TRI. In this example, during the subframe period in which the forward subframe data of the bit B0 is applied to the reflecting electrodes PEa and PEb, the common electrode voltage Vcom is set to a voltage that is lower than 0 V by a threshold voltage Vtt of the liquid crystal as shown in FIG. 6(D).

The liquid crystal display elements LCa and LCb perform gradation display according to the voltage applied to the liquid crystals LCMa and LCMb that is the absolute value of a difference voltage between the voltage applied to the reflecting electrodes PEa and PEb and the common electrode voltage Vcom. Accordingly, during the subframe period (times T1 and T2) in which the forward subframe data of the bit B0 is applied to the reflecting electrodes PEa and PEb, the voltage applied to the liquid crystals LCMa and LCMb is 3.3 V+Vtt (=3.3 V−(−Vtt)) when the bit value of the subframe data is "1", and the voltage applied to the liquid crystals LCMa and LCMb is +Vtt (=0 V−(−Vtt)) when the bit value of the subframe data is "0", as shown in FIG. 6(E).

Figure 7:
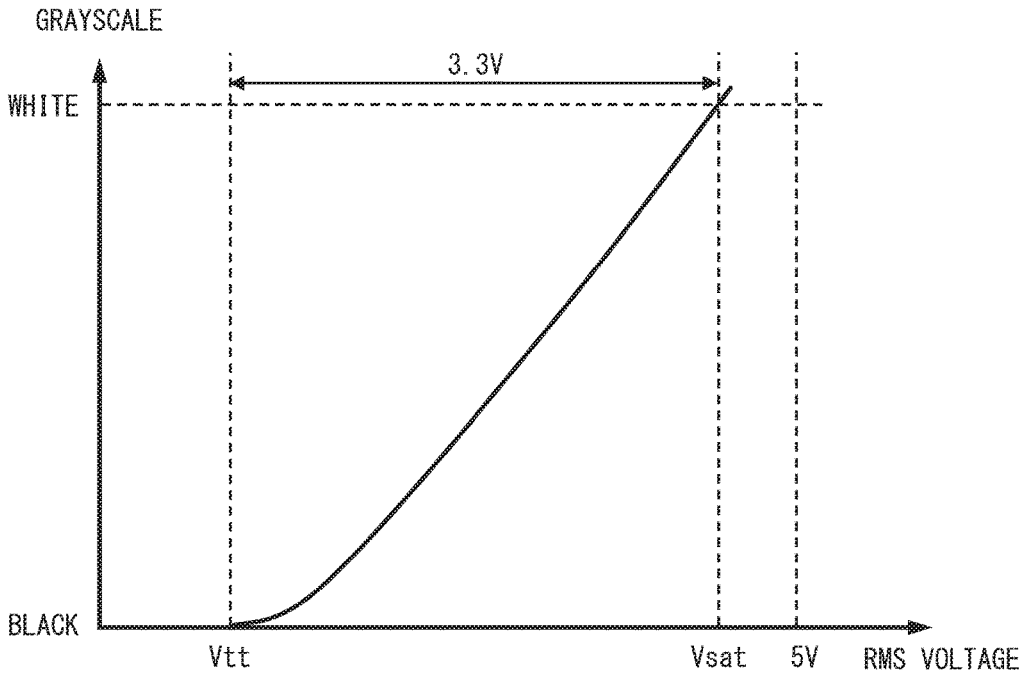
FIG. 7 is a graph showing a relationship between an applied voltage (RMS voltage) of liquid crystal and a grayscale value of liquid crystal.

FIG. 7 is a graph showing a relationship between an applied voltage (RMS voltage) of liquid crystal and a grayscale value of liquid crystal.

Referring to FIG. 7, a grayscale value curve is shifted in such a manner that the grayscale value for black corresponds to the RMS voltage of the threshold voltage Vtt and the grayscale value for white corresponds to the RMS voltage of a saturating voltage Vsat (=3.3 V+Vtt) of the liquid crystal. The grayscale value can be matched with an effective portion of a liquid crystal response curve. Therefore, the liquid crystal display elements LCa and LCb display white when the voltage applied to the liquid crystals LCMa and LCMb is (3.3 V+Vtt), and the liquid crystal display elements LCa and LCb display black when the voltage applied to the liquid crystals LCMa and LCMb is +Vtt.

Referring again to FIG. 6, during the subframe period (times T1 and T2) in which the liquid crystal display elements LCa and LCb display the forward subframe data of the bit B0, writing of the inverted subframe data of the bit B0 into the storage units SM1*a* and SM1*b* of all the pixels 12A and 12B constituting the image display unit 11 is started in sequence. After the inverted subframe data of the bit B0 is written into the storage units SM1*a* and SM1*b* of all the pixels 12A and 12B constituting the image display unit 11, the H-level trigger pulse TRI (and the L-level trigger pulse TRIB) is supplied to all the pixels 12A and 12B, which constitute the image display unit 11, at the same time (time T2).

As a result, the switches SW2*a* and SW2*b* of all the pixels 12A and 12B are turned on, so that the inverted subframe data of the bit B0 stored in the storage units SM1*a* and SM1*b* is simultaneously transferred and held in the capacitances C1*a* and C1*b* through the switches SW2*a* and SW2*b*, and is applied to the reflecting electrodes PEa and PEb. As seen from FIG. 6(C), the period in which the inverted subframe data of the bit B0 is held by the capacitances C1*a* and C1*b* (the period in which the inverted subframe data of the bit B0 is applied to the reflecting electrodes PEa and PEb) corresponds to one subframe period from the time (time T2) when the trigger pulse TRI becomes H-level to the time (time T3) when the trigger pulse TRI becomes H-level next time. In this case, the inverted subframe data of the bit B0 and the forward subframe data of the bit B0 are in the relation of reverse logical values all the time. Accordingly, when the forward subframe data of the bit B0 indicates "1", the inverted subframe data of the bit B0 indicates "0", while when the forward subframe data of the bit B0 indicates "0", the inverted subframe data of the bit B0 indicates "1".

During the subframe period in which the inverted subframe data of the bit B0 is applied to the reflecting electrodes PEa and PEb, the common electrode voltage Vcom is set to a voltage that is higher than 3.3 V by the threshold voltage Vtt of the liquid crystal as shown in FIG. 6(D). Accordingly, during the subframe period (times T2 and T3) in which the inverted subframe data of the bit B0 is applied to the reflecting electrodes PEa and PEb, the voltage applied to the liquid crystals LCMa and LCMb is −Vtt (=3.3 V−(3.3 V+Vtt)) when the bit value of the subframe data is "1", and the voltage applied to the liquid crystals LCMa and LCMb is −3.3 V−Vtt (=0 V−(3.3 V+Vtt)) when the bit value of the subframe data is "0".

For example, when the bit value of the forward subframe data of the bit B0 is "1", the bit value of the inverted subframe data of the bit B0 to be subsequently applied is "0". At this time, the voltage applied to the liquid crystals LCMa and LCMb is −(3.3 V+Vtt). The potential direction of the voltage applied to the liquid crystals LCMa and LCMb is opposite to that when the forward subframe data of the bit B0 is applied, but the absolute value of the voltage applied to the liquid crystals LCMa and LCMb is the same as that when the forward subframe data of the bit B0 is applied. Therefore, also when the inverted subframe data of the bit B0 is applied, the pixels 12A and 12B display white in a manner similar to when the forward subframe data of the bit B0 is applied. Further, when the bit value of the forward subframe data of the bit B0 is "0", the bit value of the applied inverted subframe data of the bit B0 is "1". At this time, the voltage applied to the liquid crystals LCMa and LCMb is −Vtt. The potential direction of the voltage applied to the liquid crystals LCMa and LCMb is opposite to that when the forward subframe data of the bit B0 is applied, but the absolute value of the voltage applied to the liquid crystals LCMa and LCMb is the same as that when the forward subframe data of the bit B0 is applied. Therefore, also when the inverted subframe data of the bit B0 is applied, the pixels 12A and 12B display black in a manner similar to when the forward subframe data of the bit B0 is applied.

Accordingly, as shown in FIG. 6(E), during two subframe periods of times T1 to T3, the pixels 12A and 12B display the bit B0 and the complementary bit B0*b* of the bit B0 with the same gradation, and perform AC driving for inverting the potential direction of the liquid crystals LCMa and LCMb for each subframe, thereby preventing burn-in of the liquid crystals LCMa and LCMb.

Subsequently, during the subframe period (times T2 and T3) in which the liquid crystal display elements LCa and LCb display the inverted subframe data of the bit B0, writing of the forward subframe data of the bit B1 into the storage units SM1*a* and SM1*b* of all the pixels 12A and 12B is started in sequence. After the forward subframe data of the bit B1 is written into the storage units SM1*a* and SM1*b* of all the pixels 12A and 12B of the image display unit 11, the H-level trigger pulse TRI (and the L-level trigger pulse TRIB) is simultaneously supplied to all the pixels 12A and 12B constituting the image display unit 11 (time T3).

As a result, the switches SW2*a* and SW2*b* of all the pixels 12A and 12B are turned on, so that the forward subframe data of the bit B1 stored in the storage units SM1*a* and SM1*b* is simultaneously transferred and held in the capacitances C1*a* and C1*b* through the switches SW2*a* and SW2*b*, and is applied to the reflecting electrodes PEa and PEb. As seen from FIG. 6(C), the period in which the forward subframe data of the bit B1 is held by the capacitances C1*a* and C1*b* (the period in which the forward subframe data of the bit B1 is applied to the reflecting electrodes PEa and PEb) corresponds to one subframe period from the time (time T3) when the trigger pulse TRI becomes H-level to the time (time T4) when the trigger pulse TRI becomes H-level next time.

On the other hand, the common electrode voltage Vcom is set to a voltage that is lower than 0 V by the threshold voltage Vtt of the liquid crystal as shown in FIG. 6(D), during the subframe period in which the forward subframe data of the bit B1 is applied to the reflecting electrodes PEa and PEb. Accordingly, during the subframe period (times T3 and T4) in which the forward subframe data of the bit B1 is applied to the reflecting electrodes PEa and PEb, as shown in FIG. 6(E), the voltage applied to the liquid crystals LCMa and LCMb is 3.3 V+Vtt (=3.3 V−(−Vtt)) when the bit value of the subframe data is "1", and the voltage applied to the liquid crystals LCMa and LCMb is +Vtt (=0 V−(−Vtt)) when the bit value of the subframe data is "0".

Subsequently, during the subframe period (times T3 and T4) in which the liquid crystal display elements LCa and LCb display the forward subframe data of the bit B1, writing of the inverted subframe data of the bit B1 into the storage units SM1*a* and SM1*b* of all the pixels 12A and 12B constituting the image display unit 11 is started in sequence. After the inverted subframe data of the bit B1 is written into the storage units SM1*a* and SM1*b* of all the pixels 12A and 12B constituting the image display unit 11, the H-level trigger pulse TRI (and the L-level trigger pulse TRIB) is simultaneously supplied to all the pixels 12A and 12B constituting the image display unit 11 (time T4).

As a result, the switches SW2*a* and SW2*b* of all the pixels 12A and 12B are turned on, so that the inverted subframe data of the bit B1 stored in the storage units SM1*a* and SM1*b* is simultaneously transferred and held in the capacitances C1*a* and C1*b* through the switches SW2*a* and SW2*b*, and is applied to the reflecting electrodes PEa and PEb. As seen from FIG. 6(C), the period in which the inverted subframe data of the bit B1 is held by the capacitances C1*a* and C1*b* (the period in which the inverted subframe data of the bit B1 is applied to the reflecting electrodes PEa and PEb) corresponds to one subframe period from the time (time T4) when the trigger pulse TRI becomes H-level to the time (time T5) when the trigger pulse TRI becomes H-level next time. In this case, the inverted subframe data of the bit B1 and the forward subframe data of the bit B1 are in the relation of reverse logical values (in the complementary relation) all the time.

On the other hand, the common electrode voltage Vcom is set to a voltage that is higher than 3.3 V by the threshold voltage Vtt of the liquid crystal as shown in FIG. 6(D), during the subframe period in which the inverted subframe data of the bit B1 is applied to the reflecting electrodes PEa and PEb. Accordingly, during the subframe period (times T4 and T5) in which the inverted subframe data of the bit B1 is applied to the reflecting electrodes PEa and PEb, the voltage applied to the liquid crystals LCMa and LCMb is −Vtt (=3.3 V−(3.3 V+Vtt)) when the bit value of the subframe data is "1", and the voltage applied to the liquid crystals LCMa and LCMb is −3.3 V−Vtt (=0 V−(3.3 V+Vtt)) when the bit value of the subframe data is "0".

Thus, as shown in FIG. 6(E), during two subframe periods of times T3 to T5, the pixels 12A and 12B display the bit B1 and the complementary bit B1*b* of the bit B1 with the same gradation, and perform AC driving for inverting the potential direction of the liquid crystals LCMa and LCMb for each subframe, thereby preventing burn-in of the liquid crystals LCMa and LCMb. The same operation is repeated for the bit B2 and the subsequent bits.

In this manner, the liquid crystal display device 10 performs gradation display with a combination of a plurality of subframes.

Each display period of the bit B0 and the complementary bit B0*b* corresponds to a first subframe period, and each display period of the bit B1 and the complementary bit B1*b* corresponds to a second subframe period. However, the first subframe period and the second subframe period are not necessarily the same period. In this case, for example, the second subframe period is set to be twice the first subframe period. As shown in FIG. 6(E), a third subframe period, which corresponds to each display period of the bit B2 and the complementary bit B2*b*, is set to be twice the second subframe period. The same holds true for the other subframe periods. The length of each subframe period and the number of subframes can be arbitrarily set depending on the specifications of the system and the like.

(Pixel Inspection Method for Liquid Crystal Display Device 10)

Next, a pixel inspection method for the liquid crystal display device 10 will be described with reference to FIG. 8.

Figure 8:
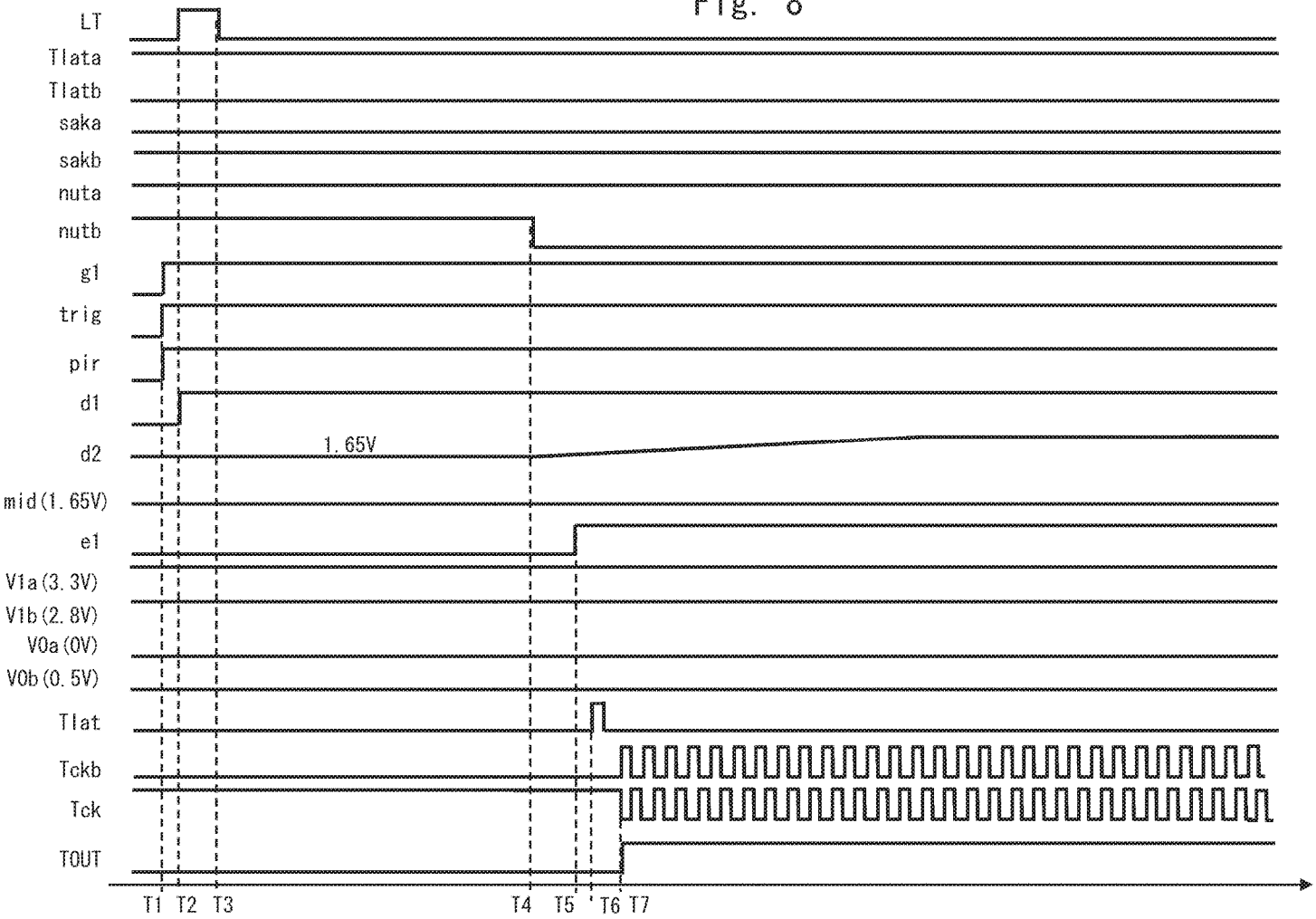
FIG. 8 is a timing diagram showing an operation during pixel inspection of the liquid crystal display device shown in FIG. 1.

FIG. 8 is a timing diagram showing an operation during pixel inspection of the liquid crystal display device 10.

The first exemplary embodiment illustrates an example in which during pixel inspection, the pixels 12A connected to the column data lines dod (d1, d3, . . . , and dn−1) in the odd-numbered columns are set as pixels in which H-level test data is written, and the pixels 12B connected to the column data lines dev (d2, d4, . . . , and dn) in the even-numbered columns are set to pixels from which the test data (test result) is read out. The pixels into which the test data is written may be replaced by the pixels from which the test data is red out.

First, at the time of starting the pixel inspection, a H-level row scanning signal is supplied to a specific row scanning line g1, thereby turning on the switch SW1*a* of the pixel 12A and the switch SW1*b* of the pixel 12B (time T1).

An H-level forward trigger pulse and an L-level reverse trigger pulse are supplied to the trigger lines trig and trigb, respectively, thereby turning on the switch SW2*a* of the pixel 12A and the switch SW2*b* of the pixel 12B, respectively (time T1).

Further, the H-level forward trigger pulse and the L-level reverse trigger pulse are supplied to lines pir and pirb, respectively, thereby turning on the switch SW3 provided between the adjacent pixels 12A and 12B (time T1). In this case, the switch SW3 is a known transmission gate composed of a PMOS transistor MP3 and an NMOS transistor MN3. The PMOS transistor MP3 is provided between the node N2*a* of the pixel 12A and the node N2*b* of the pixel 12B, and ON/OFF of the PMOS transistor MP3 is controlled by the voltage supplied from the line pirb. The NMOS transistor MN3 is provided between the node N2*a* of the pixel 12A and the node N2*b* of the pixel 12B, and ON/OFF of the NMOS transistor MN3 is controlled by the voltage supplied from the line pir. Accordingly, the switch SW3 is turned on, which allows the path between the node N2*a* of the pixel 12A and the node N2*b* of the pixel 12B to be rendered conductive through the switch SW3.

Since the switch SW3 is a known transmission gate, the switch SW3 can transfer a wide range of voltage from the ground voltage GND to the power supply voltage VDD in the ON state. More specifically, when the voltage applied to the sources of the transistors MN3 and MP3 from the node N2*a* of the pixel 12A is at the power supply voltage VDD level (H-level), the source and the drain of the PMOS transistor MP3 are not rendered conductive, but instead the source and the drain of the NMOS transistor MN3 can be rendered conductive with low resistance. On the other hand, when the voltage applied to the sources of the transistors MN3 and MP3 from the node N2*a* of the pixel 12A is at the ground voltage GND level (L-level), the source and the drain of the NMOS transistor MN3 are not rendered conductive, but instead the source and the drain of the PMOS transistor MP3 can be rendered conductive with low resistance. Thus, in the switch SW3, the source and the drain of the transmission gate can be rendered conductive with low resistance, so that a wide range of voltage from the ground voltage GND to the power supply voltage VDD can be transferred in the ON state.

A signal Tlata is set to be active (H-level) and a signal Tlatb is set to be inactive (L-level). In this case, the signal Tlata is a signal for controlling ON/OFF of the switches provided between the horizontal driver 16 and the column data lines dod in the odd-numbered columns (see FIG. 1). The signal Tlatb is a signal for controlling ON/OFF of switches provided between the horizontal driver 16 and the column data lines dev in the even-numbered columns (see FIG. 1). Accordingly, the signal Tlata is set to be active and the signal Tlatb is set to be inactive. Thus, the column data lines dod connected to the pixels 12A in the odd-numbered columns are connected to the horizontal driver 16, and the column data lines dev connected to the pixels 12B in the even-numbered columns are disconnected from the horizontal driver 16. As a result, the test data can be written into the pixels 12A.

A signal saka is set to be inactive (L-level), and a signal sakb is set to be active (H-level). In this case, the signal saka is a signal for controlling ON/OFF of the switches provided between the column data lines dod in the odd-numbered columns and the inverted input terminal of any one of the sense amplifiers 17_1 to 17_*n*/2 (hereinafter referred to as the sense amplifier 17) (see FIG. 1). The signal sakb is a signal for controlling ON/OFF of the switches provided between the column data lines dev in the even-numbered columns and the non-inverted input terminal of the sense amplifier 17 (see FIG. 1). Accordingly, the signal saka is set to be inactive and the signal sakb is set to be active. Thus, the column data lines dod connected to the pixels 12A in the odd-numbered columns are disconnected from the inverted input terminal of the sense amplifier 17, and the column data lines dev connected to the pixels 12B in the even-numbered columns are connected to the non-inverted input terminal of the sense amplifier 17. As a result, the test data (test result) can be read out from the pixels 12B.

Further, a signal nuta is set to be active (H-level) and a signal nutb is set to be active (H-level). In this case, the signal nuta is a signal for controlling ON/OFF of the switches provided between the inverted input terminal of the sense amplifier 17 and a signal line (hereinafter referred to as a signal line mid) through which the intermediate voltage mid generated by the intermediate voltage generation unit 19 propagates (see FIG. 1). The signal nutb is a signal for controlling ON/OFF of the switches provided between the signal line mid and the non-inverted input terminal of the sense amplifier 17 (see FIG. 1). Accordingly, the signals nuta and nutb are set to be active, so that the intermediate voltage mid is supplied to the inverted input terminal and non-inverted input terminal of the sense amplifier 17. As a result, the intermediate voltage mid is supplied to the column data lines dev connected to the pixels 12B in the even-numbered columns, so that the storage unit SM1*b* of each pixel 12B becomes unstable.

The intermediate voltage mid is set to, for example, ((power supply voltage VDD)−(ground voltage GND))/2. Specifically, when the power supply voltage VDD is 3.3 V and the ground voltage GND is 0 V, the intermediate voltage mid is set to about 1.65 V. However, the intermediate voltage mid is not limited to the above range, but can be arbitrarily changed within a range in which the pixel inspection can be normally performed. For example, the intermediate voltage mid is preferably set to a voltage between the voltages of the high-potential-side power supply line V1*b* and the low-potential-side power supply line V0*b* which are connected to the pixels 12B from which the test data is read out. It is necessary to set the intermediate voltage mid by taking into consideration a variation in the intermediate voltage due to a difference between the drive capabilities of a PMOS transistor and an NMOS transistor which constitute each inverter.

The high-potential-side power supply line V1*a* connected to the pixels 12A in the odd-numbered columns is supplied with a voltage of 3.3 V. The high-potential-side power supply line V1*b* connected to the pixels 12B in the even-numbered columns is supplied with a voltage of 2.8 V. The low-potential-side power supply line V0*a* connected to the pixels 12A in the odd-numbered columns is supplied with a voltage of 0 V. The low-potential-side power supply line V0*b* connected to the pixels 12B in the even-numbered columns is supplied with a voltage of 0.5 V.

After that, the latch pulse LT is set to be active (H-level) (times T2 and T3). Accordingly, H-level data is supplied to the column data line dod as a 1-bit inspection signal. As a result, H-level data is written into the connection node N1*a* between the input terminal of the inverter INV11*a* constituting the storage unit SM1*a* of each pixel 12A and the output terminal of the inverter INV12*a*. L-level data is written into a connection node between the output terminal of the inverter INV11*a* and the input terminal of the inverter INV12*a*.

Further, since the switch SW2*a* is turned on, L-level data is written into the connection node N2*a* between the switch SW2*a* and the capacitance C1*a* constituting the storage unit DM2*a* of each pixel 12A. L-level data is also written into the capacitance C1*a*.

In this case, in the storage unit SM1*a* of each pixel 12, the drive capability of the transistor constituting the inverter INV11*a* is larger than the transistor constituting the inverter INV12*a*. Accordingly, the node N1*a* functions as an input of the storage unit SM1*a*, and the node N2*a* functions as an output of the storage unit SM1*a*.

At this time, since the switch SW3 is turned on, L-level data is written into the connection node N2*b* between the switch SW2*b* and the capacitance C1*b* constituting the storage unit DM2*b* of each pixel 12B. L-level data is also written into the capacitance C1*b*.

After the writing of the test data is completed, the signal nutb in each pixel 12B is set to be inactive (L-level) (time T4), so that the signal line mid is disconnected from the column data line dev connected to each pixel 12B. As a result, the storage unit SM1*b* of each pixel 12B is to be returned to a stationary state from the unstable state.

At this time, since the switch SW2*b* is turned on, L-level data is written into a connection node between the input terminal of the inverter INV12*b* and the output terminal of the inverter INV11*b*, which constitutes the storage unit SM1*b* of each pixel B, through the switch SW2*b*. Further, H-level data is written into the connection node N1*b* between the input terminal of the inverter INV11*b* and the output terminal of the inverter INV12*b*.

Features of the present invention will now be described with reference to FIG. 9.

Figure 9:
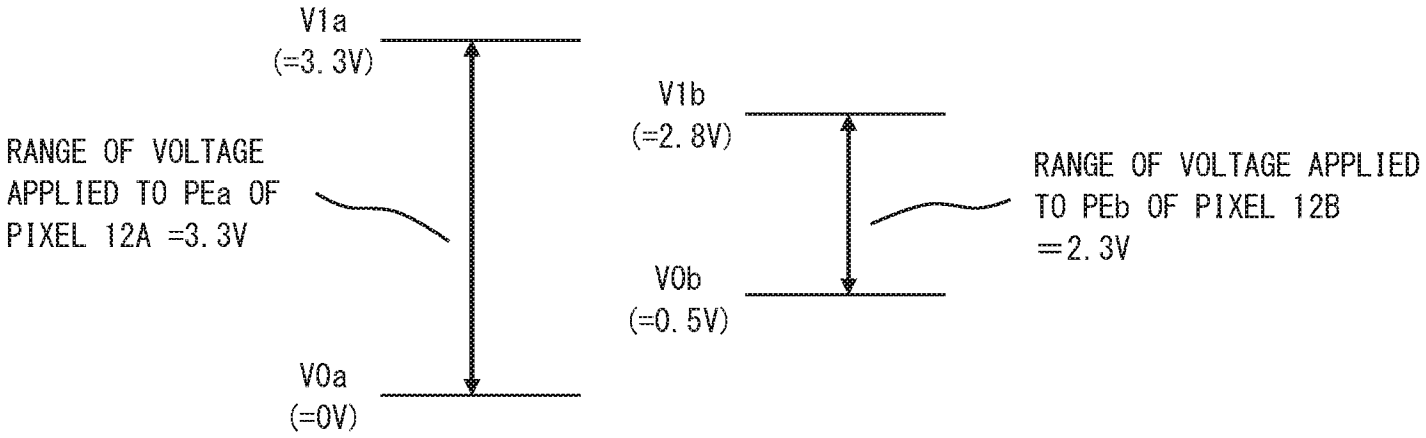
FIG. 9 is a diagram showing a range of a voltage to be applied to each reflecting electrode of a pair of pixels shown in FIG. 3.

FIG. 9 is a diagram showing a range of a voltage to be applied to the reflecting electrodes PEa and PEb of the pixels 12A and 12B, respectively.

As described above, the voltage of 3.3 V is supplied to the high-potential-side power supply line V1*a* which is connected to the pixels 12A in the odd-numbered columns. The voltage of 2.8 V is supplied to the high-potential-side power supply line V1*b* which is connected to the pixels 12B in the even-numbered columns. The voltage of 0 V is supplied to the low-potential-side power supply line V0*a* which is connected to the pixels 12A in the odd-numbered columns. The voltage of 0.5 V is supplied to the low-potential-side power supply line V0*b* which is connected to the pixels 12B in the odd-numbered columns.

Specifically, the range of an operating voltage (=V1*a*−V0*a*=3.3 V) that allows the inverters INV11*a* and INV12*a* provided in the storage unit SM1*a* of each pixel 12A to operate is set to be larger than the range of an operating voltage (=V1*b*−V0*b*=2.3 V) that allows the inverters INV11*b* and INV12*b* provided in the storage unit SM1*b* of each pixel 12B to operate. Thus, the drive capability of the inverter INV11*a* provided in the storage unit SM1*a* of each pixel 12A is larger than the drive capability of the inverter INV11*b* provided in the storage unit SM1*b* of each pixel 12B.

More specifically, the voltage V1*a* (=3.3 V) which is supplied to the sources of the PMOS transistors MP11*a* and MP12*a* provided in the storage unit SM1*a* of each pixel 12A is set to a voltage level that is higher than the voltage V1*b* (=2.8 V) which is supplied to the sources of the PMOS transistors MP11*b* and MP12*b* provided in the storage unit SM1*b* of each pixel 12B. Further, the voltage V0*a* (=0 V) which is supplied to the sources of the NMOS transistors MN11*a* and MN12*a* provided in the storage unit SM1*a* of each pixel 12A is set to a voltage level that is lower than the voltage V0*b* (=0.5 V) which is supplied to the sources of the NMOS transistors MN11*b* and MN12*b* provided in the storage unit SM1*b* of each pixel 12B.

The first exemplary embodiment illustrates an example in which the voltage V1*a* is set to a voltage level higher than the voltage V1*b* and the voltage V0*a* is set to a voltage level lower than the voltage V0*b*, but the voltages are not particularly limited. The voltages V1*a*, V1*b*, V0*a*, and V0*b* can be arbitrarily set as long as the condition that the operating voltage range of the inverters INV11*a* and INV12*a* constituting the storage unit SM1*a* of each pixel 12A is larger than the range of the operating voltage that allows the inverters INV11*b* and INV12*b* constituting the storage unit SM1*b* of each pixel 12B to operate is satisfied. For example, when the voltage V1*a* is higher than the voltage V1*b*, the voltages V0*a* and V0*b* may have the same potential. Alternatively, when the voltage V0*a* is lower than the voltage V0*b*, the voltages V1*a* and V1*b* may have the same potential. In a further alternative, if the above condition is satisfied, the voltage V1*a* may be lower than the voltage V1*b*, or the voltage V0*a* may be higher than the voltage V0*b*.

This configuration facilitates reading of the test data from each pixel 12A and writing of the test data into each pixel 12B through the switch SW3. Specifically, the transmission of the test data from the column data line dov to the column data line dev through the pixels 12A and 12B is facilitated. As a result, an accurate pixel inspection can be achieved.

Since the capacitances C1*a* and C1*b* constituting the storage units DM2*a* and DM2*b*, respectively, need to hold data during the subframe display period in the normal display state, it is necessary to minimize a leakage current when the transistors constituting the switches SW2*a*, SW2*b*, and SW3 are off. For this reason, the drive capability of each transistor is adjusted to be smaller by, for example, reducing the gate width of each transistor constituting the switches SW2*a*, SW2*b*, and SW3. However, this results in a reduction of on-current of each transistor constituting the switches SW2*a*, SW2*b*, and SW3. In other words, the on-resistance of each transistor constituting the switches SW2*a*, SW2*b*, and SW3 increases.

During pixel inspection, the switches SW2*a*, SW2*b*, and SW3 are in the ON state, and thus the on-current of each transistor is small. In other words, the on-resistance of each transistor is high. Accordingly, in the configuration of the related art, there is a possibility that the inverter INV11*a* of the storage unit SM1*a* of each pixel 12A cannot drive the inverter INV12*b* of the storage unit SM1*b* of each pixel 12B through the high-resistance switches SW2*a*, SW3, and SW2*b*. This makes it difficult to achieve an accurate pixel inspection. This phenomenon occurs remarkably due to process variations when a transistor of a corner model is used. Specifically, when NMOS and PMOS transistors with a largest allowable delay are used, the switches SW2*a*, SW3, and SW2*b* have a higher resistance, which makes it more difficult to achieve an accurate pixel inspection.

On the other hand, in the liquid crystal display device 10 according to the first exemplary embodiment, the range of the operating voltage that allows the inverters INV11*a* and INV12*a* provided in the storage unit SM1*a* of each pixel 12A to operate is set to be larger than the range of the operating voltage that allows the inverters INV11*b* and INV12*b* provided in the storage unit SM1*b* of each pixel 12B to operate. Thus, the drive capability of the inverter INV11*a* provided in the storage unit SM1*a* of each pixel 12A is larger than the drive capability of the inverter INV11*b* provided in the storage unit SM1*b* of each pixel 12B. Therefore, writing of the test data read out from each pixel 12A into each pixel 12B through the switch SW3 is facilitated even when the switches SW2*a*, SW3, and SW2*b* have a high resistance. That is, an accurate pixel inspection can be achieved.

The range of the operating voltage of the storage unit SM1*b* of each pixel 12B is reduced so as to facilitate writing of the test data into the pixel 12B from the corresponding pixel 12A, which results in a reduction of the drive capability of the inverter INV12*b* provided in the storage unit SM1*b*. Accordingly, the period of time in which the column data line dev is driven by the inverter INV12*b* increases.

When the non-inverted input terminal of the sense amplifier 17 is connected to the column data line dev and the signal nutb becomes inactive (L-level), the voltage starts shifting from the intermediate voltage mid to H-level (or L-level). On the other hand, the inverted input terminal of the sense amplifier 17 indicates the intermediate voltage mid. At the time when a small difference voltage between the non-inverted input terminal and the inverted input terminal of the sense amplifier 17 exceeds a predetermined amount, the sense amplifier 17 functions as a comparator and amplifies the difference voltage. The waveform of the amplified signal is shaped by a buffer (not shown), so that the amplified signal indicates H-level (or L-level) (time T5).

As the range of the operating voltage of the storage unit SM1*b* of each pixel 12B is set to be smaller than the range of the operating voltage of the storage unit SM1*a* of each pixel 12A, the pixel inspection can be facilitated. However, since the reaction (times T4 and T5) of the sense amplifier 17 is delayed, it is preferable to adjust the voltages V1*a*, V0*a*, V1*b*, and V0*b* in consideration of the delay.

After that, at time T6, the signal Tlat is set to be active, so that the outputs of the n/2 sense amplifiers 17_1 to 17_*n*/2 are supplied to predetermined locations in the pixel reading shift register 18. After the signal Tlat is set to be inactive, the pixel reading shift register 18 latches the outputs of the sense amplifiers 17_1 to 17_*n*/2 in synchronization with the clock signal TCK and the clock signal TCKB having a phase opposite to that of the clock signal TCK, and outputs the latched outputs in turn from the output terminal TOUT (after time T7). The operation by the clock signals TCK and TCKB is repeated by a number of times corresponding to a half of the number of pixels in one row. As a result, the test result of the pixels in one row are read out. The pixel inspection is performed by comparing the test result read out from the pixels in one row with the input test data.

For example, when the test result matches the input test data, the inspected pixels 12A and 12B are determined to be normal. When the test result is different from the input test data, the inspected pixels 12A and 12B are determined to be abnormal (failure). The abnormality in the pixels 12A and 12B is caused by, for example, short-circuit of the capacitances C1*a* and C1*b* in the GND line or the VDD line due to a failure in the production, or short-circuit or disconnection of the storage units SM1*a* and SM1*b*. When it is determined that abnormality occurs in the pixels 12A and 12B, a procedure of, for example, stopping the shipment of the liquid crystal display device can be taken.

After that, an H-level row scanning signal is supplied to the next row scanning line g2 by using the vertical shift register 14, thereby performing the pixel inspection on the pixels 12A and 12B in the next row in the same manner. These operations are repeated, with the result that the pixel inspection is performed on all the pixels 12A and 12B.

After that, the pixel inspection is performed in the same manner using L-level test data. The pixel inspection using the H-level test data and the pixel inspection using the L-level test data are preferably executed twice or more by changing the timing of the pixel inspection.

After that, the pixel inspection is performed in the same manner by replacing the pixels in which the test data is written with the pixels from which the test result is read out. Specifically, the pixels 12B are set as the pixels in which the H-level test data is written, and the pixels 12A are set as the pixels from which the test result is read out, and then the pixel inspection is performed on all the pixels. After that, the pixel inspection is performed in the same manner using the L-level test data. The pixel inspection using the H-level test data and the pixel inspection using the L-level test data are preferably executed twice or more by changing the timing of the pixel inspection.

When the pixel inspection is performed by replacing the pixels in which the test data is written with the pixels from which the test result is read out, the relationship between the active and inactive states of the signals Tlata and Tlatb, the relationship of the active and inactive states of the signals saka and sakb, and the relationship between the active and inactive states of the signals nuta and nutb are set to be opposite to those before the replacement. The relationship between the voltages V1*a* and V1*b* and the relationship between the voltages V0*a* and V0*b* are set to be opposite to those before the replacement.

The pixel inspection method is not limited to the above method. For example, test data having different voltage levels in each column of the pixels 12A and 12B may be used. In this case, a potential difference is formed between the pixel 12B connected to the column data line d2 and the pixel 12A connected to the column data line d3, which enables detection of short-circuit between pixels.

In this manner, in the liquid crystal display device 10 according to the first exemplary embodiment, the range of the operating voltage that allows the inverters INV11*a* and INV12*a* provided in the storage unit SM1*a* of each pixel 12A to operate is set to be larger than the range of the operating voltage that allows the inverters INV11*b* and INV12*b* provided in the storage unit SM1*b* of each pixel 12B to operate. Thus, the drive capability of the inverter INV11*a* provided in the storage unit SM1*a* of each pixel 12A is larger than the drive capability of the inverter INV11*b* provided in the storage unit SM1*b* of each pixel 12B. Consequently, writing of the test data read out from each pixel 12A into each pixel 12B through the switch SW3 is facilitated even when the switches SW2*a*, SW3, and SW2*b* have a high resistance. That is, an accurate pixel inspection can be achieved.

The first exemplary embodiment illustrates an example in which the n/2 sense amplifiers 17_1 to 17_*n*/2 are provided, but the present invention is not limited to this configuration. The n/2 sense amplifiers 17_1 to 17_*n*/2 need not be necessarily provided. In this case, if the period between times T4 and T5 shown in FIG. 8 is increased, the column data line d2 is shifted to the voltage V0*b* or the voltage V1*b*. When the n/2 sense amplifiers 17_1 to 17_*n*/2 are not provided, the time required for the inspection increases, but the miniaturization of the chip can be achieved.

Second Exemplary Embodiment

A liquid crystal display device 20 according to a second exemplary embodiment will be described.

Figure 10:
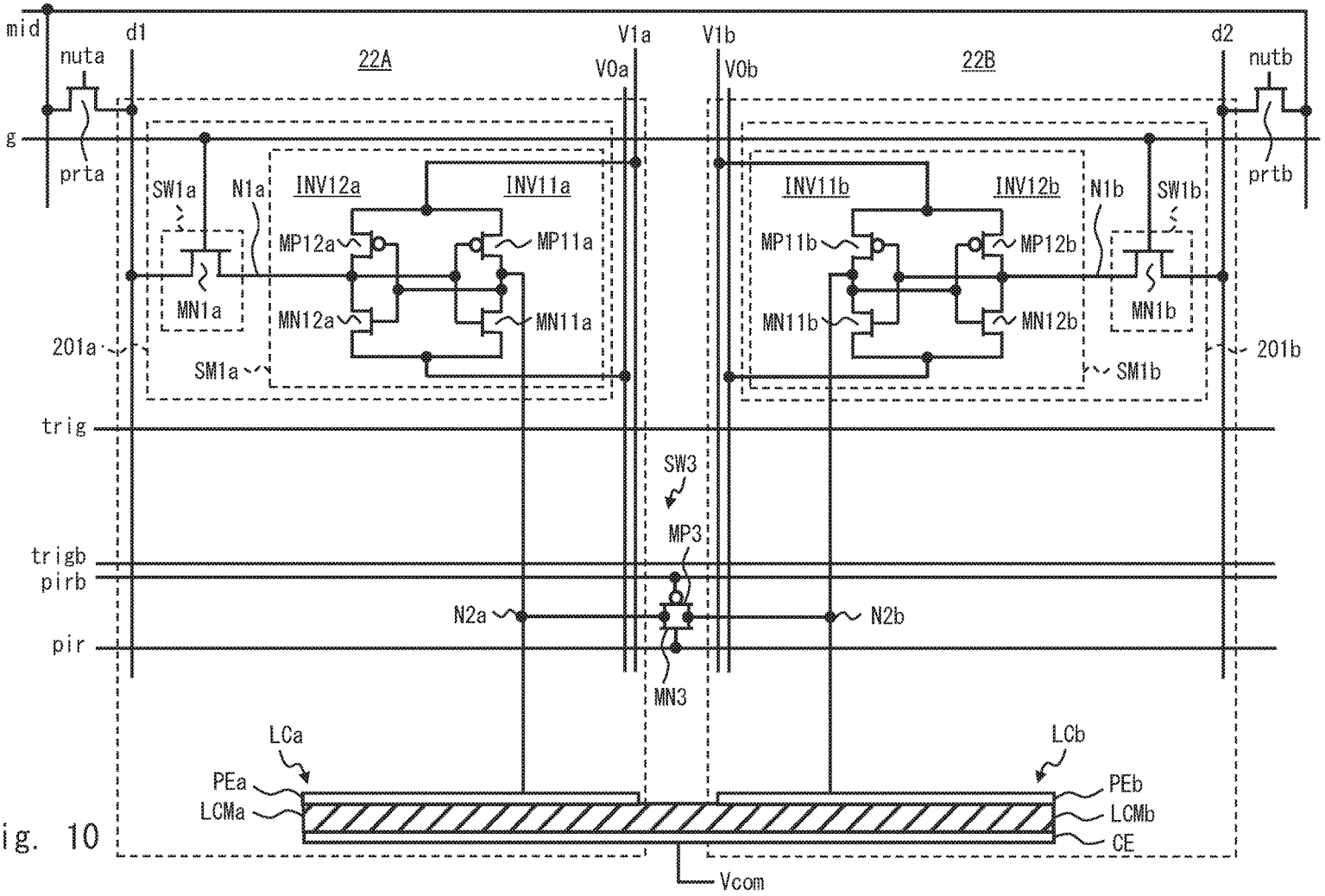
FIG. 10 is a circuit diagram showing specific configurations of a pair of pixels and peripheral circuits thereof provided in a liquid crystal display device according to a second exemplary embodiment.

FIG. 10 is a circuit diagram showing specific configurations of pixels 22A and 22B and peripheral circuits thereof provided in the liquid crystal display device 20.

As shown in FIG. 10, the pixels 22A and 22B provided in the liquid crystal display device 20 do not include the DRAM cell 202*a* and 202*b*, unlike the pixels 12A and 12B provided in the liquid crystal display device 10. More specifically, unlike the pixel 12A, the pixel 22A does not include the switches SW2*a* and the storage unit DM2*a* which constitute the DRAM cell 202*a*. Unlike the pixel 12B, the pixel 22B does not include the switch SW2*b* and the storage unit DM2*b* which constitute the DRAM cell 202*b*. In this configuration, the signals lines trig and trigb are not provided. The other configurations of the pixels 22A and 22B and the liquid crystal display device 20 including the pixels 22A and 22B are similar to those of the pixels 12A and 12B and the liquid crystal display device 10 including the pixels 12A and 12B, and thus the descriptions thereof are omitted.

The liquid crystal display device 20 according to the second exemplary embodiment is also capable of performing the pixel inspection accurately, like in the case of the liquid crystal display device 10.

As described above, in the liquid crystal display devices 10 and 20 according to the first and second exemplary embodiments, respectively, the range of the operating voltage of each of the inverters INV11*a* and INV12*a* provided in the storage unit SM1*a* of the pixels 12A and 22A is set to be larger than the range of the operating voltage of each of the inverters INV11*b* and INV12*b* provided in the storage unit SM1*b* of the pixels 12B and 22B. Accordingly, the drive capability of the inverter INV11*a* provided in the storage unit SM1*a* of the pixels 12A and 22A is larger than the drive capability of the inverter INV11*b* provided in the storage unit SM1*b* of the pixels 12B and 22B. Consequently, the test data read out from the pixels 12A and 22A can be easily written into the pixels 12B and 22B through the switch SW3, even when the switches SW2*a*, SW3, and SW2*b* have a high resistance. That is, an accurate pixel inspection can be achieved.

The first and second embodiments can be combined as desirable by one of ordinary skill in the art.

While the invention has been described in terms of several embodiments, those skilled in the art will recognize that the invention can be practiced with various modifications within the spirit and scope of the appended claims and the invention is not limited to the examples described above.

Further, the scope of the claims is not limited by the embodiments described above.

Furthermore, it is noted that, Applicant's intent is to encompass equivalents of all claim elements, even if amended later during prosecution.

What is claimed is:

1. A liquid crystal display device comprising a plurality of pixels each configured to display an image for one frame with a gradation level corresponding to a plurality of pieces of 1-bit subframe data, wherein each of the pixels includes:

a first switch configured to sample the subframe data;

a first data holding unit configured to hold the subframe data sampled by the first switch, the first data holding unit and the first switch constituting an SRAM cell; and a liquid crystal display element including: a reflecting electrode to which the subframe data held in the first data holding unit is applied; a common electrode; and a liquid crystal filled and encapsulated in a space between the reflecting electrode and the common electrode, the first data holding unit includes:

a first inverter, an input of the first inverter being connected to each of an output of a second inverter and the first switch, an output of the first inverter being connected to an input of the second inverter; and the second inverter, an input of the second inverter being connected to the output of the first inverter, the output of the second inverter being connected to the input of the first inverter, the liquid crystal display device further includes a conductive switch configured to be turned on during pixel inspection, the conductive switching being disposed between the reflecting electrodes of first and second pixels among the plurality of pixels, the first pixel including the first switch connected to a first data line, the second pixel including the first switch connected to a second data line, and a range of a source voltage of each of an NMOS transistor and a PMOS transistor constituting each of the first and second inverters provided in the first pixel is configured to be able to be set separately from a range of a source voltage of each of an NMOS transistor and a PMOS transistor constituting each of the first and second inverters provided in the second pixel.

2. The liquid crystal display device according to claim 1, wherein each of the pixels further includes:

a second switch configured to sample the subframe data held in the first data holding unit, simultaneously with the other pixels; and a second data holding unit configured to hold the subframe data sampled by the second switch, the second data holding unit and the second switch constituting a DRAM cell, and in each of the pixels, the subframe data held in the second data holding unit is applied to the reflecting electrode of the liquid crystal display element.

3. The liquid crystal display device according to claim 1, wherein a source electrode of each PMOS transistor constituting the first and second inverters provided in the first pixel and a source electrode of each PMOS transistor constituting the first and second inverters provided in the second pixel are configured to be individually supplied with a second high-potential-side voltage, the second high-potential-side voltage being different from a first high-potential-side voltage to be supplied to each well electrode.

4. The liquid crystal display device according to claim 1, wherein a source electrode of each NMOS transistor constituting the first and second inverters provided in the first pixel and a source electrode of each NMOS transistor constituting the first and second inverters provided in the second pixel are configured to be individually supplied with a second low-potential-side voltage, the second low-potential-side voltage being different from a first low-potential-side voltage to be supplied to each well electrode.

5. The liquid crystal display device according to claim 1, further comprising a sense amplifier configured to amplify a difference voltage between an intermediate voltage and a voltage of a test result output from the second data line in response to input of test data to the first data line during pixel inspection.

6. The liquid crystal display device according to claim 5, wherein during pixel inspection, the second data line is precharged to a predetermined voltage before the test data is input to the first data line.

7. The liquid crystal display device according to claim 1, further comprising a shift register configured to latch a voltage output from the second data line in response to application of a voltage to the first data line, and sequentially output the latched voltage.

8. A pixel inspection method for a liquid crystal display device including a plurality of pixels each configured to display an image for one frame with a gradation level corresponding to a plurality of pieces of 1-bit subframe data, each of the pixels including:

a first switch configured to sample the subframe data;

a first data holding unit configured to hold the subframe data sampled by the first switch, the first data holding unit and the first switch constituting an SRAM cell; and a liquid crystal display element including: a reflecting electrode to which the subframe data held in the first data holding unit is applied; a common electrode; and a liquid crystal filled and encapsulated in a space between the reflecting electrode and the common electrode, the first data holding unit including:

a first inverter, an input of the first inverter being connected to each of an output of a second inverter and the first switch, an output of the first inverter being connected to an input of the second inverter; and the second inverter, an input of the second inverter being connected to the output of the first inverter, the output of the second inverter being connected to the input of the first inverter, the liquid crystal display device further including a conductive switch disposed between the reflecting electrodes of first and second pixels among the plurality of pixels, the first pixel including the first switch connected to a first data line, the second pixel including the first switch connected to a second data line, a range of a source voltage of each of an NMOS transistor and a PMOS transistor constituting each of the first and second inverters provided in the first pixel being configured to be able to be set separately from a range of a source voltage of each of an NMOS transistor and a PMOS transistor constituting each of the first and second inverters provided in the second pixel, the pixel inspection method for the liquid crystal display device, comprising:

turning on the conductive switch;

a voltage setting step of setting the range of the source voltage of each of the NMOS transistor and the PMOS transistor constituting each of the first and second inverters provided in the first pixel to be larger than the range of the source voltage of each of the NMOS transistor and the PMOS transistor constituting each of the first and second inverters provided in the second pixel;

inputting test data to the first data line; and determining presence or absence of a failure in the first and second pixels based on a test result output from the second data line in response to input of the test data to the first data line.

9. The pixel inspection method for the liquid crystal display device according to claim 8, wherein each of the pixels further includes:

a second switch configured to sample the subframe data held in the first data holding unit, simultaneously with the other pixels; and a second data holding unit configured to hold the subframe data sampled by the second switch, the second data holding unit and the second switch constituting a DRAM cell, and in each of the pixels, the subframe data held in the second data holding unit is applied to the reflecting electrode of the liquid crystal display element.

10. The pixel inspection method for the liquid crystal display device according to claim 8, wherein in the voltage setting step, a source electrode of each PMOS transistor constituting the first and second inverters provided in the first pixel and a source electrode of each PMOS transistor constituting the first and second inverters provided in the second pixel are individually supplied with a second high-potential-side voltage, the second high-potential-side voltage being different from a first high-potential-side voltage to be supplied to each well electrode.

11. The pixel inspection method for the liquid crystal display device according to claim 8, wherein in the voltage setting step, a source electrode of each NMOS transistor constituting the first and second inverters provided in the first pixel and a source electrode of each NMOS transistor constituting the first and second inverters provided in the second pixel are individually supplied with a second low-potential-side voltage, the second low-potential-side voltage being different from a first low-potential-side voltage to be supplied to each well electrode.

12. The pixel inspection method for the liquid crystal display device according to claim 8, further comprising amplifying a difference voltage between an intermediate voltage and a voltage of the test result output from the second data line in response to input of the test data to the first data line.

13. The pixel inspection method for the liquid crystal display according to claim 12, further comprising precharging the second data line to a predetermined voltage before the test data is input to the first data line.

14. The pixel inspection method for the liquid crystal display device according to claim 8, further comprising latching the test result output from the second data line in response to input of the test data to the first data line, and sequentially outputting the latched test result.

* * * * *